US008340338B2

(12) United States Patent
Mlodzikowski et al.

(10) Patent No.: US 8,340,338 B2
(45) Date of Patent: Dec. 25, 2012

(54) ADJUSTABLE SHAPE EARPHONE

(75) Inventors: Allan Mlodzikowski, Muskego, WI (US); Iain Roberts, Chicago, IL (US); George Aye, Chicago, IL (US); Jerry O'Leary, Chicago, IL (US); Michael J. Koss, Milwaukee, WI (US); Martin Thaler, Chicago, IL (US); Michael J. Pelland, Princeton, WI (US)

(73) Assignee: Koss Corporation, Milwaukee, WI (US)

( * ) Notice: Subject to any disclaimer, the term of this patent is extended or adjusted under 35 U.S.C. 154(b) by 135 days.

(21) Appl. No.: 12/811,354

(22) PCT Filed: Dec. 31, 2008

(86) PCT No.: PCT/US2008/088656

§ 371 (c)(1),
(2), (4) Date: Oct. 28, 2010

(87) PCT Pub. No.: WO2009/086555

PCT Pub. Date: Jul. 9, 2009

(65) Prior Publication Data

US 2012/0155689 A1 Jun. 21, 2012

Related U.S. Application Data

(60) Provisional application No. 61/009,690, filed on Dec. 31, 2007.

(51) Int. Cl.
*H04R 25/00* (2006.01)

(52) U.S. Cl. ..... 381/380; 381/328; 381/370

(58) Field of Classification Search ..... 381/328, 381/329, 370, 380
See application file for complete search history.

(56) References Cited

U.S. PATENT DOCUMENTS

| | | | | |
|---|---|---|---|---|
| 4,133,984 | A | 1/1979 | Akiyama | |
| 4,539,440 | A | 9/1985 | Sciarra | |
| 7,182,087 | B1 | 2/2007 | Marsh | |
| 7,362,875 | B2 | 4/2008 | Saxton et al. | |
| 7,425,196 | B2 * | 9/2008 | Jorgensen et al. | 600/25 |
| 7,477,756 | B2 * | 1/2009 | Wickstrom et al. | 381/380 |
| 7,639,831 | B2 * | 12/2009 | Hagberg | 381/380 |
| 7,664,540 | B2 | 2/2010 | Tsai | |
| 2002/0090099 | A1 | 7/2002 | Hwang | |
| 2004/0258263 | A1 | 12/2004 | Saxton et al. | |
| 2006/0140426 | A1 | 6/2006 | Berg | |
| 2007/0036376 | A1 | 2/2007 | Fried | |
| 2007/0218962 | A1 | 9/2007 | Tsai | |

FOREIGN PATENT DOCUMENTS

WO WO 2005/048828 A1 6/2005

OTHER PUBLICATIONS

International Search Report and Written Opinion for PCT/US08/88656, Feb. 17, 2009 (7 pages).
International Preliminary Report on Patentability for PCT/US08/88656, Jun. 9, 2010 (7 pages).

* cited by examiner

*Primary Examiner* — Brian Ensey
(74) *Attorney, Agent, or Firm* — K&L Gates LLP

(57) ABSTRACT

This disclosure relates to an adjustable ear insert, such as an earbud style earphone, that may be inserted in a user's ear canal in a compact configuration and adjusted by a user to expand and fit snugly against the ear canal.

18 Claims, 31 Drawing Sheets

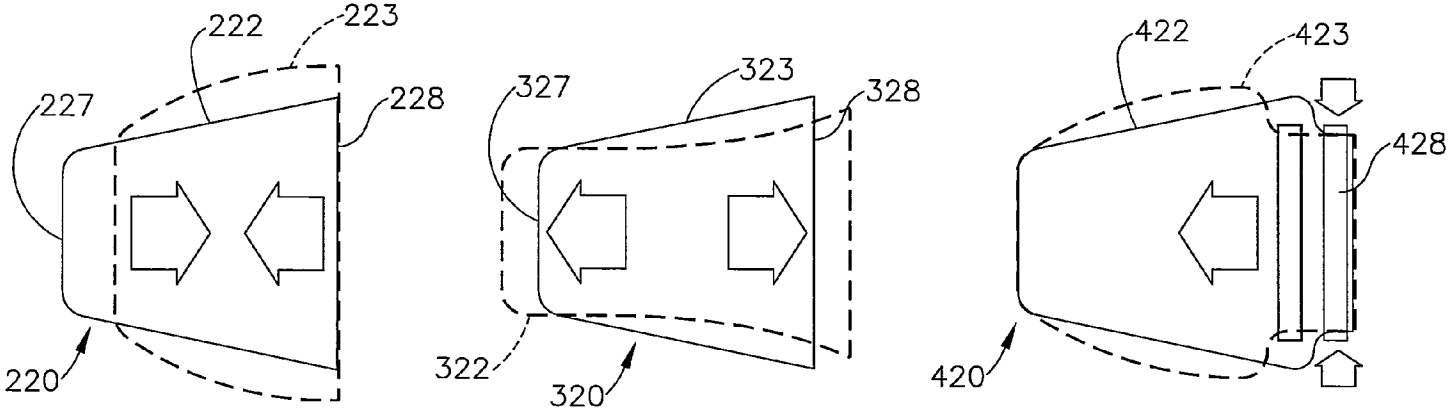
FIG. 2A
FIG. 2B
FIG. 2C
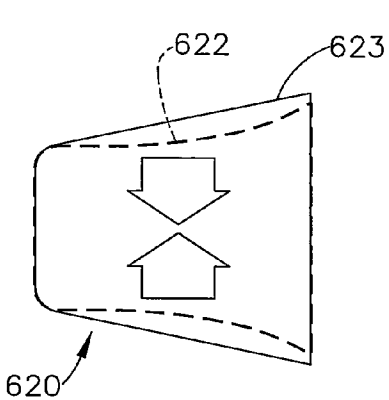
FIG. 2E
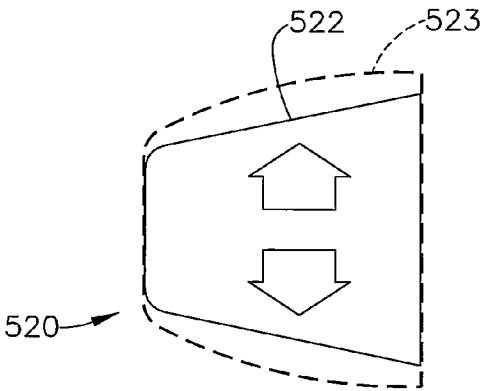
FIG. 2D

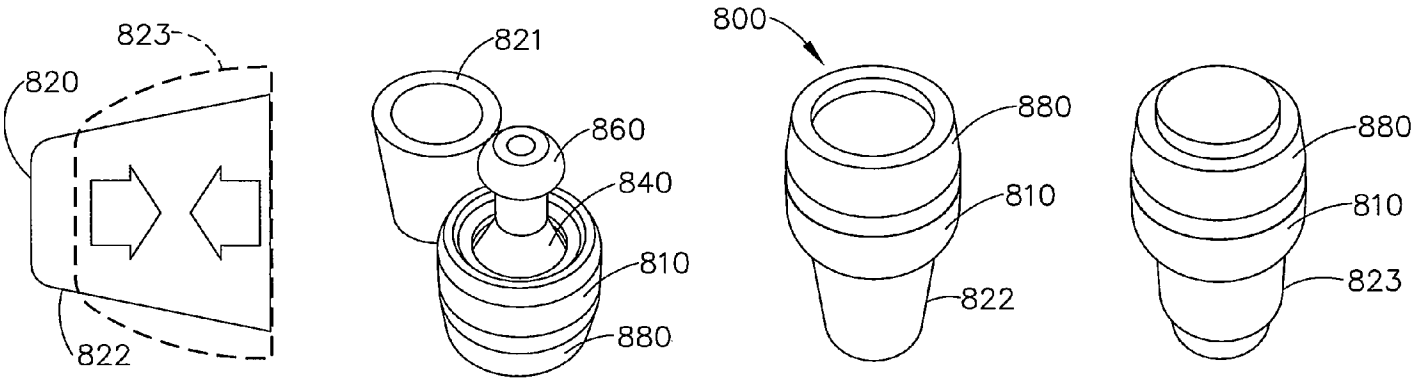
FIG. 5A
FIG. 5B
FIG. 5C
FIG. 5D
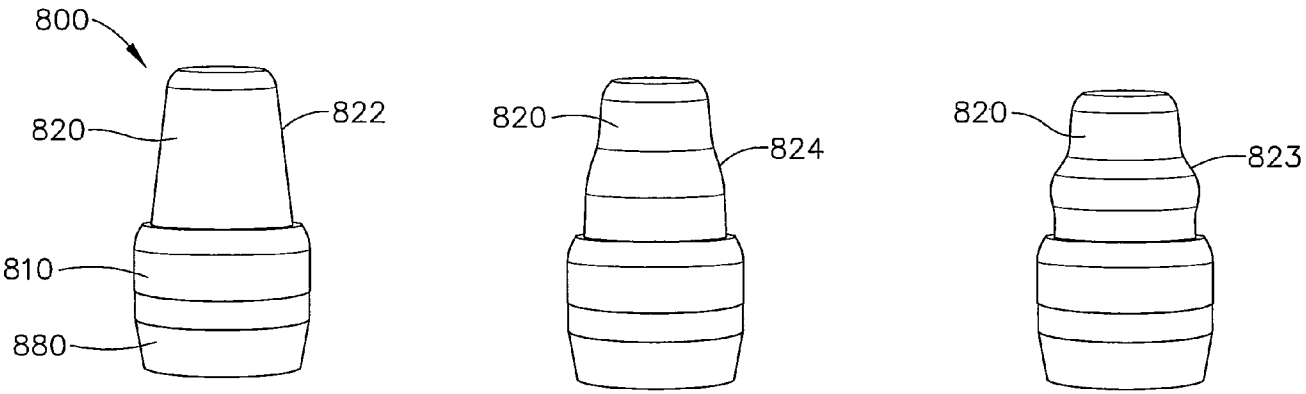
FIG. 5E
FIG. 5F
FIG. 5G

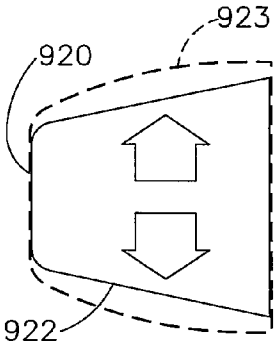
FIG. 8A
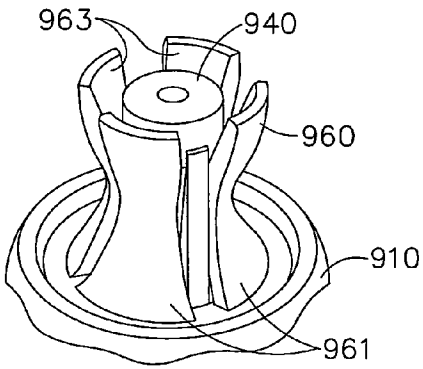
FIG. 8B
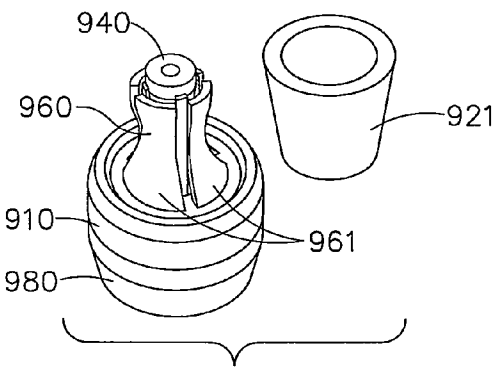
FIG. 8C
FIG. 8D
FIG. 8E
FIG. 8F
FIG. 8G

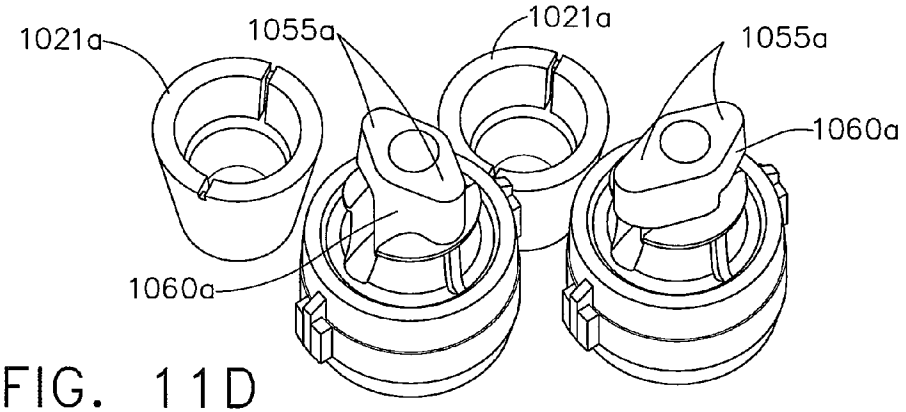
FIG. 11D
FIG. 11E
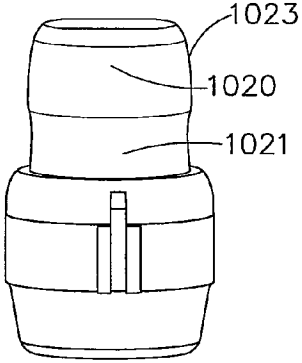
FIG. 11F
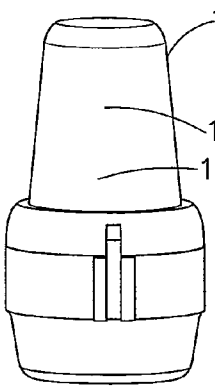
FIG. 11G
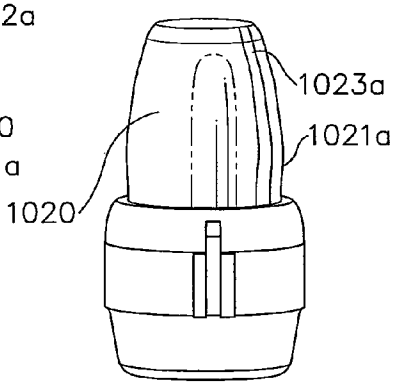
FIG. 11H

ADJUSTABLE SHAPE EARPHONE

PRIORITY CLAIM

This application is a United States national stage application of and claims the benefit of International Application Number PCT/US2008/088656, entitled ADJUSTABLE SHAPE EARPHONE, filed Dec. 31, 2008, which claims the benefit of U.S. Provisional Application Ser. No. 61/009,690, entitled ADJUSTABLE FIT EARBUD, CLOTH COVERED CORD AND CORD CLIP ZIPPER, filed Dec. 31, 2007; the contents of both of which are incorporated herein by reference in their entirety.

BACKGROUND

The present disclosure generally relates to adjustable ear inserts and more particularly to earphones for listening to audio media, such as that which may be played from portable audio devices.

Earphones are usually a pair of small loudspeakers that are provided with a mechanism to hold them close to a user's ears and a means of connecting them to a signal source such as an audio amplifier, radio, or portable audio device, such as a CD or MP3 player.

Earbuds are earphones of a small size that are placed directly outside or in the ear canal. Some earbuds, called external-canal earbuds, are designed to sit outside the ear canal. These are generally inexpensive and are favored for their portability and convenience. However, due to their inability to provide sound isolation, they are incapable of delivering the same dynamic range offered by many full-sized headphones and ear-canal earbuds (described below) for a given volume level. As a result, they are often used at higher volumes in order to drown out noise from the user's surroundings. Over time, earbuds became a common type of earphone bundled with portable audio devices.

Internal-canal earbuds are earbuds that are inserted directly into the ear canal. These offer portability similar to external-canal earbuds, and also act like earplugs to block out environmental noise. There are two main types of internal-canal earbuds: universal and custom. Universal internal-canal earphones provide one or more stock sleeve size(s) to fit various ear canals, which are commonly made out of silicone rubber, elastomer, or foam, for noise isolation. Universal internal-canal earbuds are marketed typically to casual listeners and are relatively inexpensive, though some offer very high audio quality.

Custom internal-canal earbuds are fitted to individuals. Castings of the ear canals are made, usually by an audiologist. The manufacturer uses the castings to create custom-molded silicone rubber or elastomer plugs that provide added comfort and noise isolation. Because of the individualized labor involved, custom internal-canal earbuds are more expensive than universal internal-canal earbuds.

Consequently, there is a need for improved internal-canal earbuds. The foregoing discussion is intended only to illustrate some of the shortcomings present in the field of the invention at the time, and should not be taken as a disavowal of claim scope.

SUMMARY

The present invention includes, in various embodiments, an adjustable shape earphone. In at least one embodiment, the earphone includes: (i) a housing having a first side and a second side; (ii) a resilient cushion attached to the first side of the housing, the resilient cushion having a compact shape and an opening; (iii) at least one cantilever arm protruding from the first side of the housing, where at least part of the cantilever arm is located within the opening of the resilient cushion; (iv) a dial rotatably mounted in the housing, where at least part of the dial extends from the second side of the housing and where the dial includes threads; and (v) an actuator comprising a first portion and a second portion, where the second portion has threads. The actuator is mounted slidably in the housing, and the actuator threads operably engage the dial threads such that rotation of the dial in a first direction translates the first portion of the rigid actuator into contact with the cantilever arm. Further, the first portion of the actuator is configured to bend the cantilever arm into the resilient cushion as the actuator contacts the arm, and the cantilever arm is subsequently configured to force the resilient cushion to have an expanded shape as the cantilever arm bends into the cushion.

In another embodiment, the adjustable earphone includes: (i) a housing having a first side and a second side, where the first side of the housing is configured to attach to a cushion; (ii) at least one cantilever arm protruding from the first side of the housing, where at least part of the cantilever arm is configured to be located within an opening of the cushion when the cushion is attached to the housing; (iii) a dial rotatably mounted in the housing, where at least part of the dial extends from the second side of the housing, and where the dial includes threads; and (iv) an actuator comprising a first portion and a second portion, the second portion having threads. The actuator is slidably mounted in the housing, with the actuator threads operably engaging the dial threads such that rotation of the dial in a first direction translates the first portion of the rigid actuator into contact with the cantilever arm. In addition, the first portion of the actuator is configured to bend the cantilever arm as the actuator contacts the arm.

In yet another embodiment, the adjustable earphone includes: (i) a housing; (ii) an ear canal portion adjacent to the housing, the ear canal portion having a first shape; (iii) and an adjustment assembly operably coupled to the housing. The adjustment assembly includes: (i) a movable member movable with respect to the housing between a first position and at least a second position; (ii) an expansion assembly configured to receive the movable member; and (iii) a control member configured to move the movable member such that actuation of the control member causes the movable member to move from a first position to at least a second position. Further, the movable member is configured to cause the expansion assembly to expand in at least one direction when the movable member is moved to the second position. Subsequently, the expansion assembly is configured to force the ear canal portion to have at least a second shape when the expansion assembly is expanded.

In yet other embodiments, the adjustable earphone includes: (i) an ear canal portion having a shape, where the ear canal portion is operable for placement in a user's ear canal; and (ii) means for adjusting the shape of the ear canal portion by a user when the ear canal portion is positioned in the user's ear.

In yet other embodiments, the present invention provides an adjustable ear insert including: (i) an ear canal portion configured for insertion in a user's ear canal, the ear canal portion having a first shape; and (ii) an adjustment assembly at least partially located within the ear canal portion, where the adjustment assembly is operable to cause the ear canal portion to have at least a second shape.

In yet other embodiments, the adjustable ear insert includes: (i) an inner end having an eartip, where the inner end is configured to be placed within an ear canal of a user; (ii) and an outer end having a control feature, where the outer end is configured to remain outside the ear canal, and where the control feature is accessible by the user to expand or compact the eartip.

In these and other various embodiments, an adjustable ear insert is capable of insertion into a user's ear canal and then may be adjusted by the user to create a snug fit between the ear canal and an ear canal portion of the adjustable ear insert. In other words, the ear canal portion is capable of being adjusted to substantially seal the ear canal portion against the user's ear canal. Where the adjustable ear insert is an earphone, such a snug fit or seal provides, among other things, enhanced noise isolation from external noises other than those produced by the earphone, and sound enhancement for sound produced by the earphone. Where the adjustable ear insert is an earplug, such a snug fit or seal provides, among other things, enhanced noise isolation from external noises. Further, the in-ear adjustability of the ear canal portion provides an ear insert that should not require different sized ear canal portions for different users.

BRIEF DESCRIPTION OF THE FIGURES

The features of the various embodiments are set forth with particularity in the appended claims. The various embodiments, however, both as to organization and methods of operation, may best be understood by way of example with reference to the following description, taken in conjunction with the accompanying drawings as follows.

FIGS. 2A-2B are diagrams showing compact and expanded shapes of various ear canal portions of adjustable earphones according to various embodiments.

FIGS. 5A-5G are several illustrations of some of the various ear canal portion shapes made possible by the adjustable earphone of FIG. 4.

FIGS. 8A-8G are several illustrations of some of the various ear canal portion shapes made possible by the adjustable earphone of FIG. 7.

FIGS. 11A-11H are several illustrations of some of the various ear canal portion shapes made possible by the adjustable earphone of FIG. 10.

DETAILED DESCRIPTION

Figure 1A:
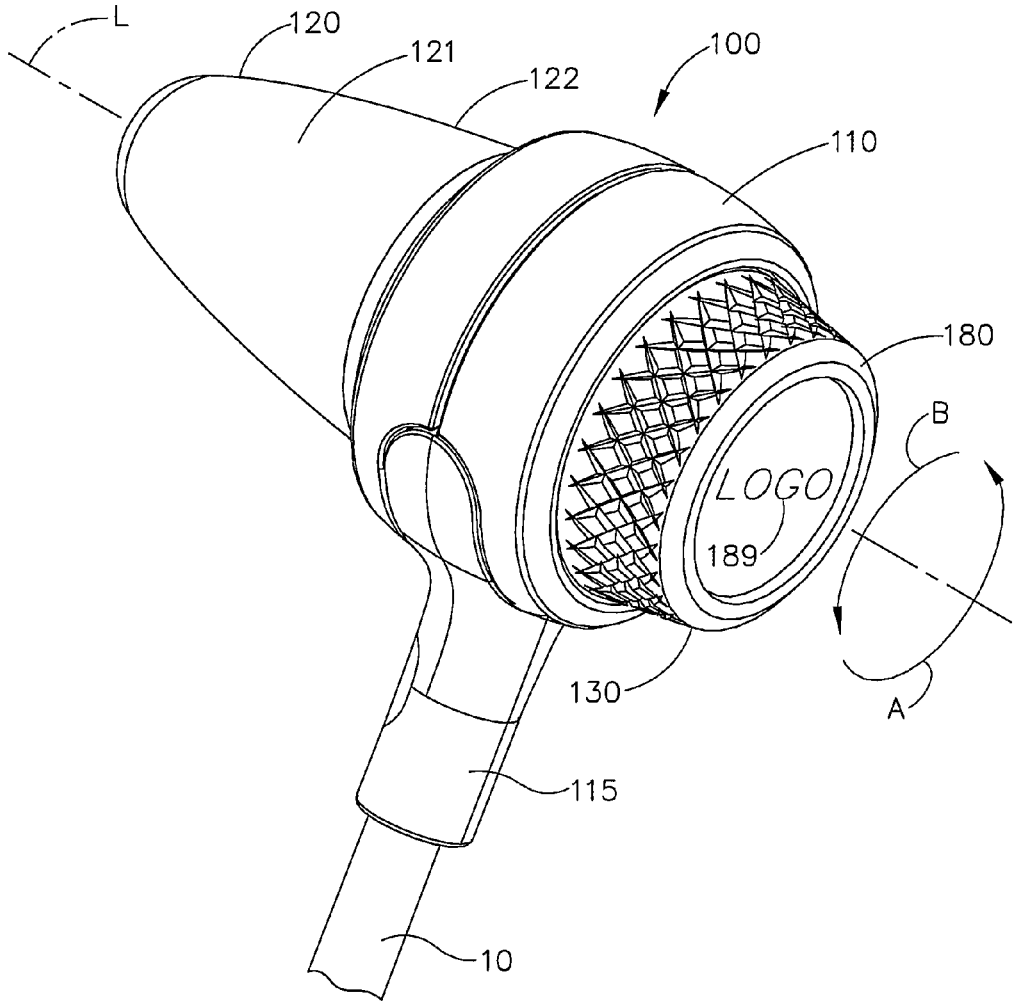
FIG. 1A is a perspective view of a wired adjustable earphone according to one non-limiting embodiment.

Certain exemplary embodiments will now be described to provide an overall understanding of the principles of the structure, function, manufacture, and use of the devices and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the various embodiments of the present invention is defined solely by the claims. The features illustrated or described in connection with one exemplary embodiment may be combined with the features of other embodiments. Such modifications and variations are intended to be included within the scope of the present invention.

In the following description, like reference characters designate like or corresponding parts throughout the several views. In addition, in the following description, it is to be understood that such terms as "forward," "rearward," "front," "back," "right," "left," "upwardly," "downwardly," and the like are words of convenience and are not to be construed as limiting terms. The description below is for the purpose of describing various embodiments of the invention and is not intended to limit the invention thereto.

Figure 18B:
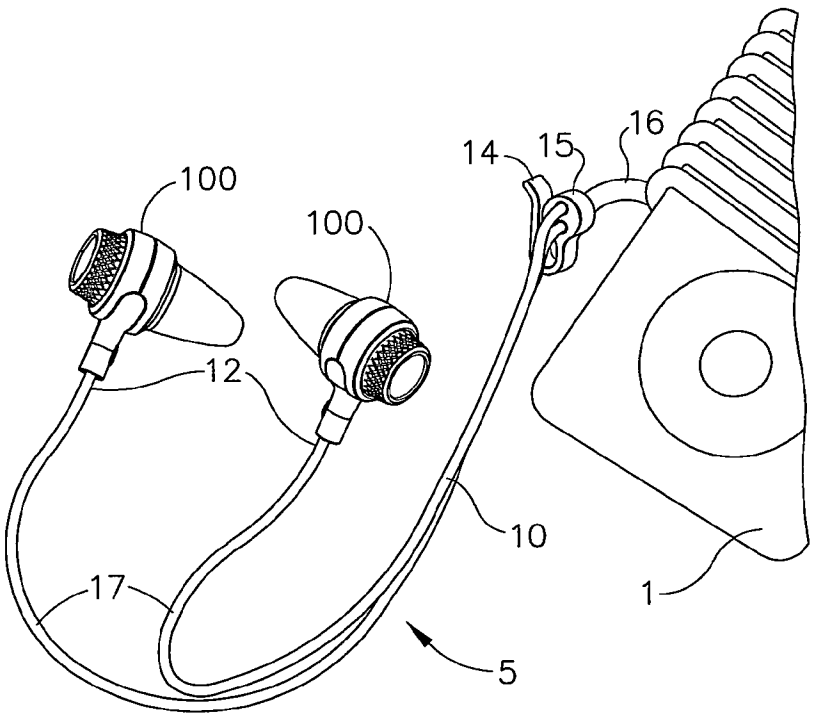
FIG. 18B is a perspective view of a portion of an earphone assembly including a cord only partially wrapped around an audio device.
Figure 18A:
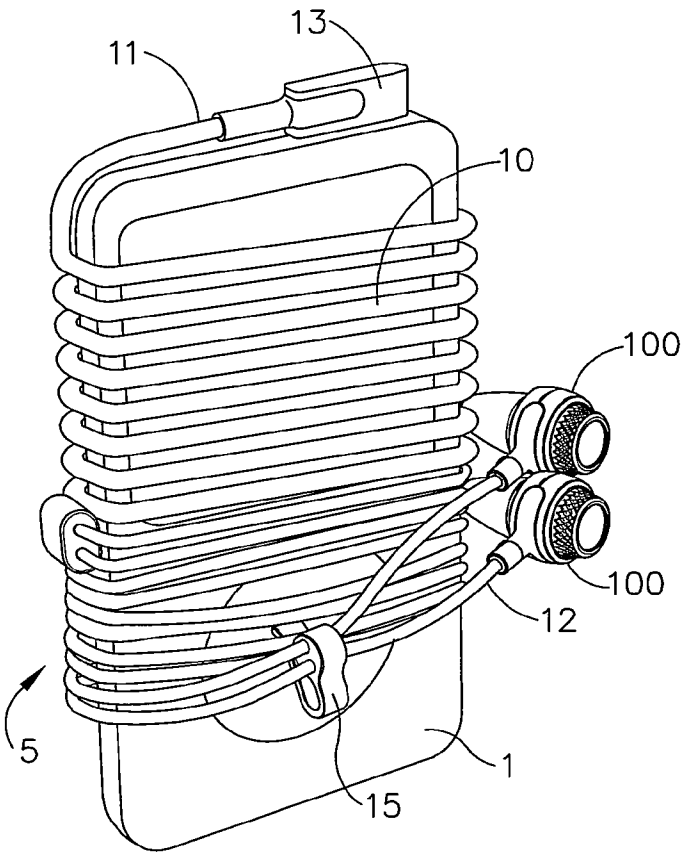
FIG. 18A is a perspective view of an earphone assembly including a cord wrapped around an audio device.
Figure 19B:
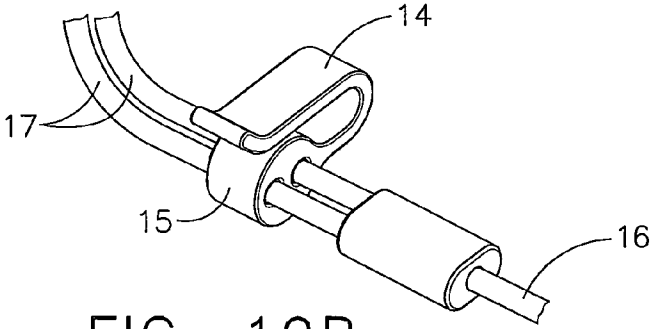
FIG. 19B is an illustration of a spring clip from the earphone assembly of FIGS. 18A and 18B.
Figure 19C:
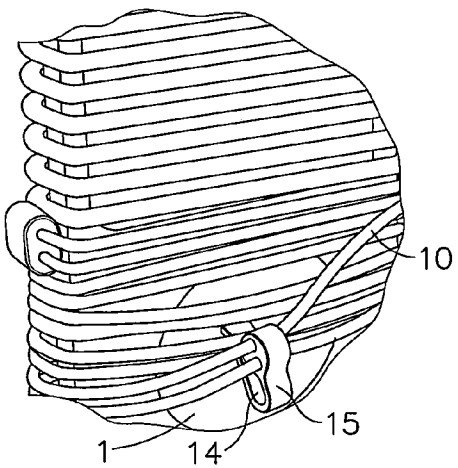
FIG. 19C is an illustration of the spring clip of FIG. 19B being used to hold in place the wrapped cord of the earphone assembly of FIG. 18A.
Figure 19A:
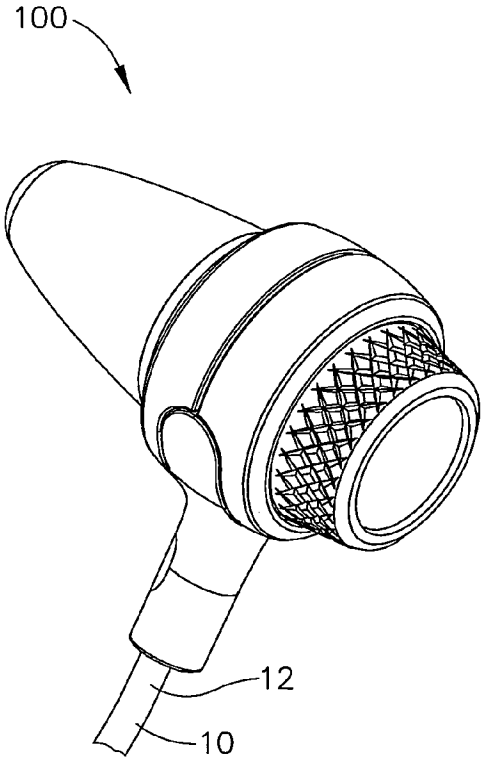
FIG. 19A is a perspective view of an adjustable earphone from the earphone assembly of FIGS. 18A and 18B.

The various embodiments described herein are directed to devices intended to be placed in an ear canal, such as an earphone assembly usable with an audio device. Referring to FIGS. 18A and 18B, an earphone assembly 5 includes a cord 10 and a pair of earphones 100. The cord 10 has a first end 11, a second end 12, and an electrical connector 13 located at the first end 11. The electrical connector 13 connects the earphone assembly 5 to an audio device 1 such that electrical signals may be conveyed through the cord 10, to each earphone 100, where the electrical signal may be converted to audible sounds by a transducer (see, e.g., FIGS. 24 and 27). As is known in the field, a transducer is a device, usually electrical, electronic, electro-mechanical, electromagnetic, photonic, or photovoltaic, that converts one type of energy or physical attribute to another for various purposes, including producing audible sounds. The term transducer may be used to refer to an audio loudspeaker, which converts electrical voltage variations representing music or speech, to mechanical cone vibration, and hence vibrates air molecules creating sound.

Each earphone 100 is located at the second end 12 of the cord. The cord 10 further includes a first portion 16 adjacent to the first end 11 of the cord 10 and a second portion 17 adjacent to the second end 12 of the cord 10. The first portion 16 includes a single strand and the second portion 17 includes two strands such that the two earphones 100 may be placed in the ears of a user, with one strand of the second portion 17 on each side of the users head.

Figure 1B:
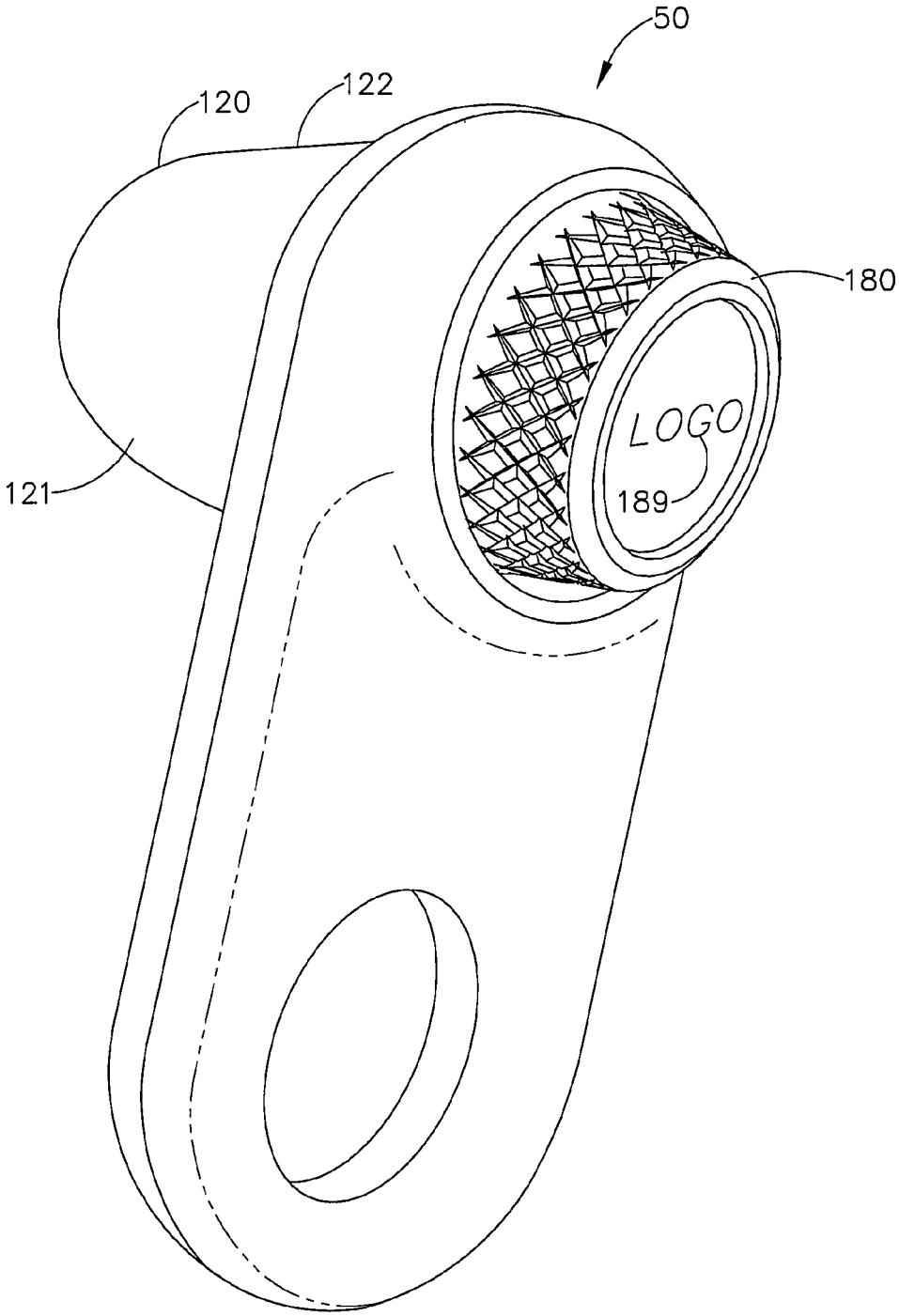
FIG. 1B is a is a perspective view of a wireless adjustable earphone according to one non-limiting embodiment
Figure 26:
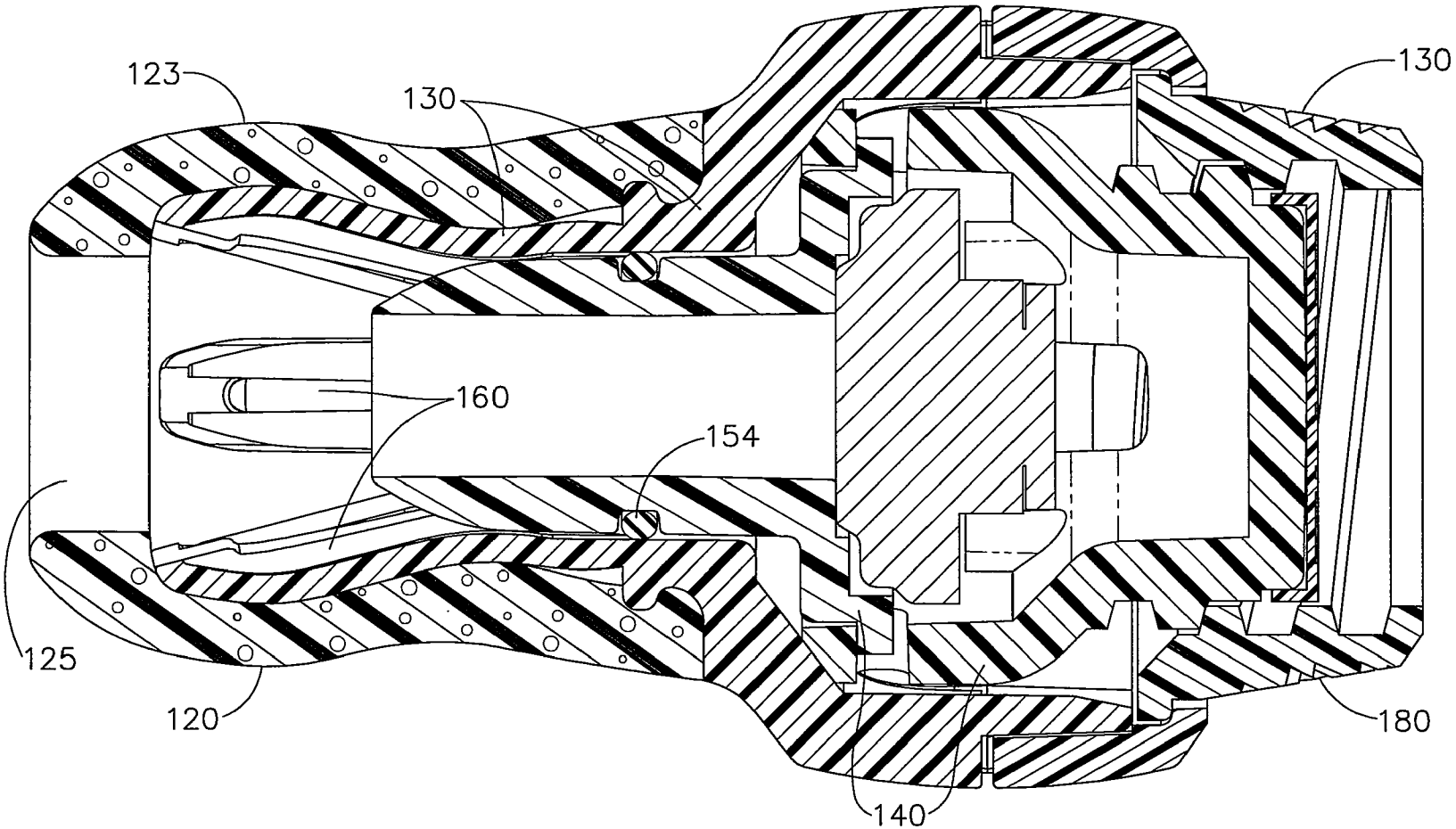
FIG. 26 is a top cross-sectional view, taken along line 26-26 in FIG. 22, of the adjustable earphone of FIG. 21A, with the ear canal portion shown having an expanded, second shape.
Figure 27:
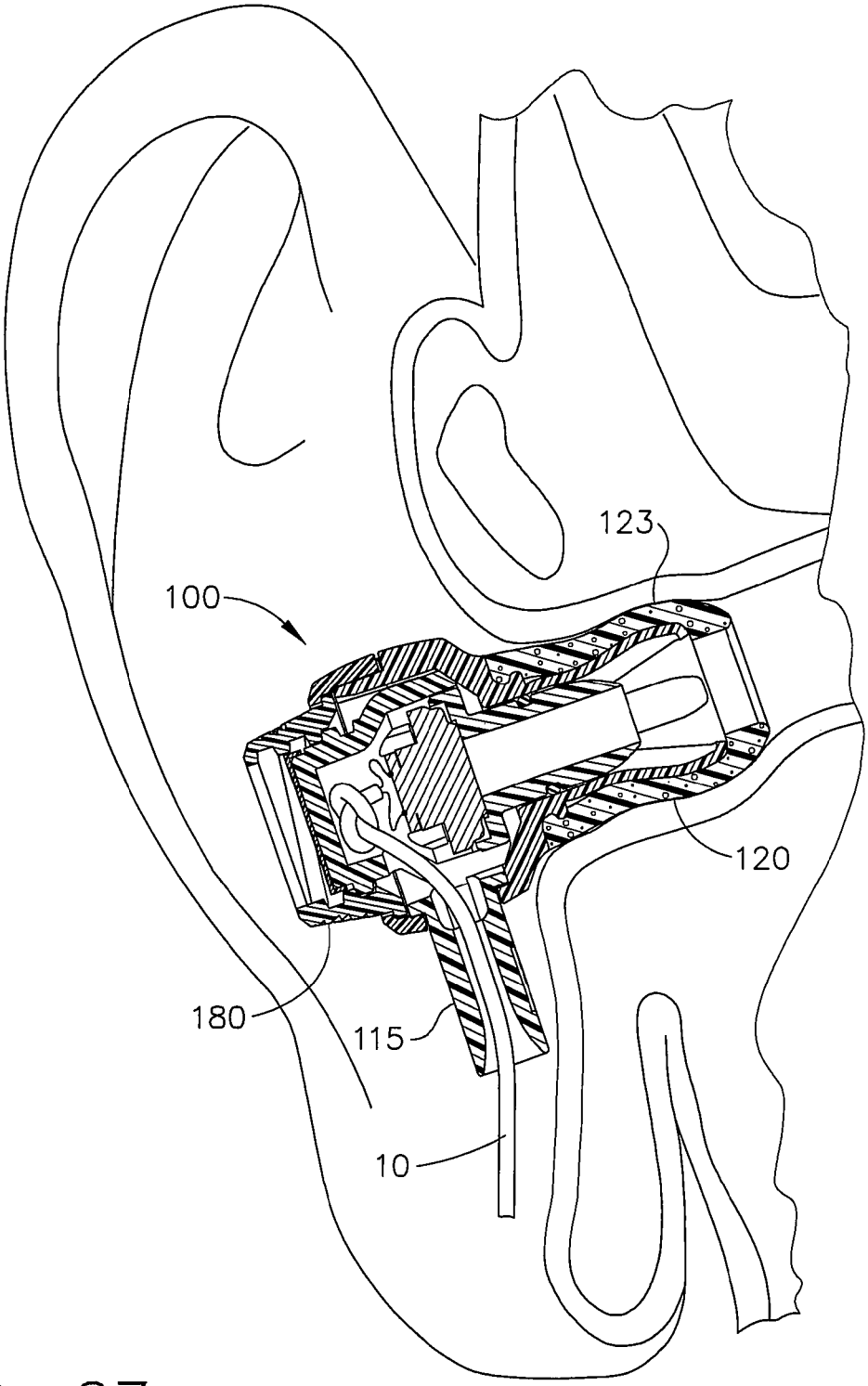
FIG. 27 is a side cross-sectional view of the adjustable earphone of FIG. 21A inserted and expanded in a user's ear canal.

As shown in FIGS. 1A and 1B, a wired (FIG. 1A) or wireless (FIG. 1B) earbud style earphone (100, 50 respectively) according to an aspect of the present disclosure includes an eartip cushion 121 that may be inserted in a user's ear canal in a compact configuration, or first shape 122, and, once in the ear canal, expanded to an expanded configuration, or second shape 123 (see FIG. 26), to fit snugly against all sides of the ear canal (see, e.g., FIG. 27). The resulting customized fit provides improved audio isolation by blocking external sounds from reaching the user's eardrum, as well as improved comfort by allowing the user to determine the amount of pressure exerted by the eartip, or ear canal portion 120, on the interior of the ear canal. Further, forming a near airtight seal between the ear canal portion 120 and the user's ear canal should not only reduce the outside ambient noise that reaches the user's eardrum, but should also provide a sound transducer (see FIGS. 24 and 27) of the earphone 120 with a 1:1 acoustic coupling with the user's eardrum, thus enhancing the audible sound perceived by the user. The eartip cushion 121 may be fabricated from a foam material. While the earphone of FIG. 1A or 1B will typically be returned to its compact configuration, or first shape 122, prior to removal from the user's ears, the compressible material of the eartip, or ear canal portion 120, may allow the earbud to be removed while still in its expanded configuration.

Still referring to FIGS. 1A and 1B, expansion of the eartip may be achieved by twisting or pressing on a control 180 on an exterior surface of the earbud. Where expansion is achieved by twisting a control 180 about longitudinal axis L in the direction of arrow A and/or B, a manufacturer's logo 189 displayed on the control 180 may be attached to the control by a mechanism (described below) that allows the logo 189 to remain substantially upright and readable regardless of the rotation of the control 180.

Figure 20:
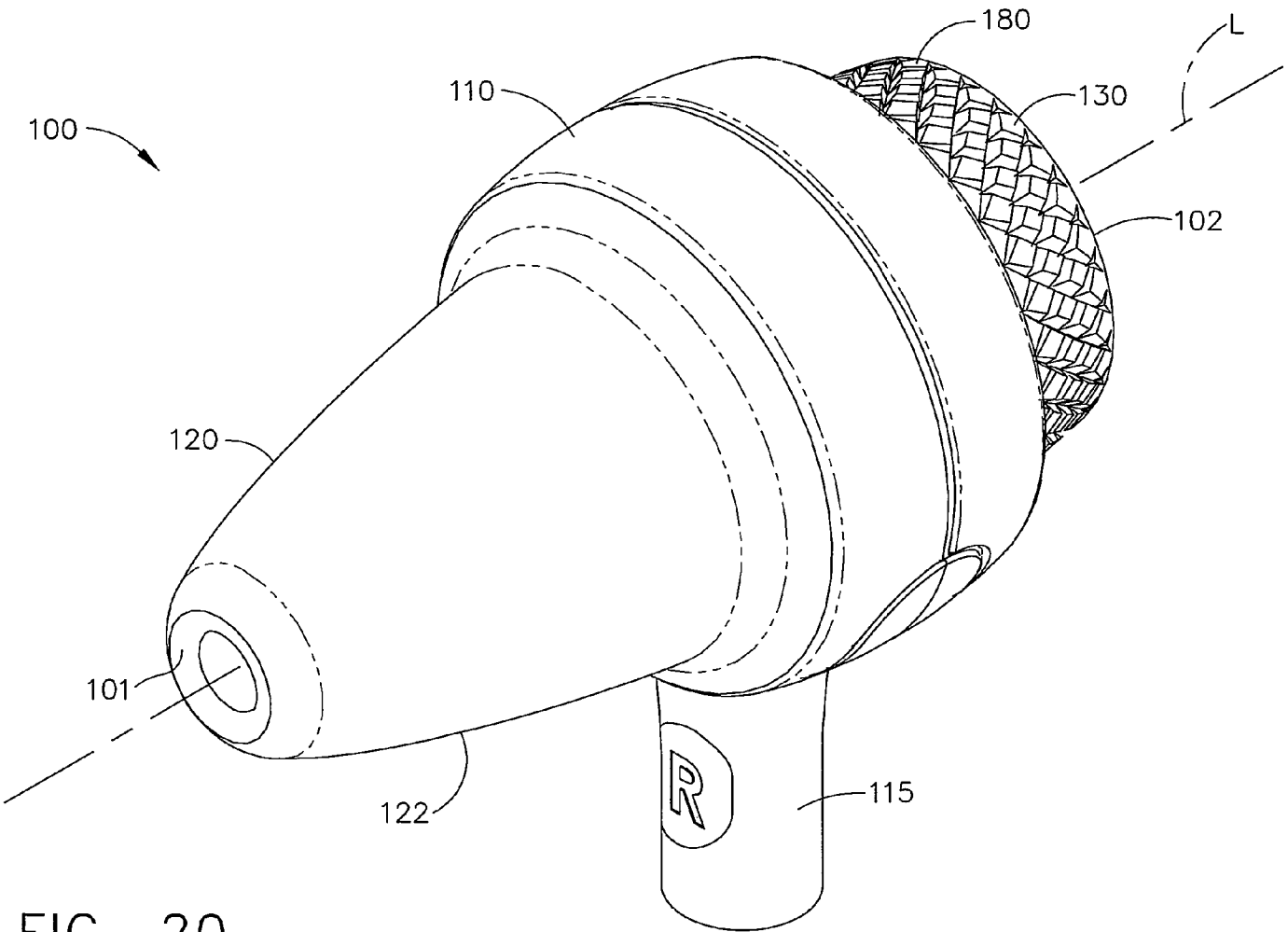
FIG. 20 is a perspective view of one non-limiting embodiment of an adjustable earphone having a rotatable dial.

In various embodiments, referring now to FIGS. 20-27, an adjustable earphone, such as adjustable earphone 100, for example, can comprise a housing 110, an ear canal portion 120, and an adjustment assembly 130. The housing may have a first side 111 and a second side 112 (see FIGS. 21A and 24). Adjacent to and attached to the first side 111 of the housing is the ear canal portion 120. Ear canal portion 120 generally defines longitudinal axis L (see FIG. 20) and is operable for placement in a user's ear canal (see, e.g., FIG. 27). Ear canal portion 120 is shown in FIG. 20 having a shape that includes a compact, first shape 122 to facilitate initial placement of the ear canal portion 120 in the user's ear canal and may include a cushion 121 (see FIGS. 21A and 21B). Cushion 121 generally has an opening 125 that, as is described in more detail below, may receive part of an expansion assembly 160. Further, cushion 121 includes a housing groove 127 (FIG. 24) designed to receive or snap on a protruding ring 118 of the housing 110 such that cushion 121 may attach releasably to the housing 110. Cushion 121 may be stretchable and made of a resilient, compressible material. The resilient material may include a foam, a memory foam, a closed-cell foam, an open-cell foam, an elastomer, an elastomeric foam, silicone, and/or rubber. The ear canal portion 120, including cushion 121, may be capable of being adjusted to have an expanded, second shape 123 (see FIG. 26). Further, ear canal portion 120, including cushion 121, may also be capable of being adjusted to have intermediate shapes, or at least a third shape (not shown). In other words, the shape of the ear canal portion 120 may be changed to have any number of shapes, including a continuum of shapes between the first shape 122 and the second shape 123. The purpose of adjusting the shape of the ear canal portion 120 is to allow a user to change the shape of the ear canal portion 120, after insertion in the user's ear canal, to have a snug fit between the ear canal and a substantial part of the ear canal portion 120. Such a snug fit provides noise isolation (from external noises other than those produced by the earphone 100) and sound enhancement (for sound produced by the earphone 100), among other things. Further, the in-ear adjustability of the ear canal portion 120 provides an earphone 100 that should not require different sized ear canal portions 120 or cushions 121 for different users; in other words, the adjustable earphone 100 may provide a one-size-fits-all device owing to the customized fit offered by the adjustability of the ear canal portion.

In various embodiments, referring again to FIGS. 20-27, the adjustable earphone 100 may include means for adjusting the shape of the ear canal portion 120 by a user when the ear canal portion 120 is positioned in the user's ear canal. Means for adjusting the shape of the ear canal portion 120 may be provided in at least one embodiment by adjustment assembly 130. Adjustment assembly 130 may be operably coupled to the housing 110 and/or to the ear canal portion 120 such that actuation of the adjustment assembly 130 causes the ear canal portion 120 to have at least a second shape 123.

Generally, according to various non-limiting embodiments, the adjustment assembly 130 may include a movable member 140, an expansion assembly 160, and a control member 180. The movable member 140 may be movable with respect to the housing 110 between a first position (see FIG. 25) and at least a second position (see FIG. 26). The expansion assembly 160 may be configured to receive the movable member 140, and the control member 180 may be configured to move the movable member 140 with respect to the housing 110. Actuation of the control member 180 may cause the movable member 140 to move from the first position (see FIG. 25) to the second position (see FIG. 26). The movable member may be configured to cause the expansion assembly 160 to expand in at least one direction when the movable member is moved to the second position (FIG. 26). Relatedly, the expansion assembly may be configured to force the ear canal portion 120 to have at least a second shape 123 when the expansion assembly 160 is expanded. Conversely, the expansion assembly 160 may be configured to retract in at least one direction when the movable member is moved to the first position (FIG. 25), thus resulting in the ear canal portion returning to the first shape 122 when the expansion assembly 160 is retracted.

In more detail, according to at least one non-limiting embodiment, the movable member 140 may include a first portion 150 and a second portion 142 that together serve as an actuator (see FIGS. 21A and 24), as explained in more detail below. Generally, the movable member moves along longitudinal axis L (see FIG. 20) and is designed to move relative to the housing such that the first portion 150 of the movable member 140 may engage the expandable member 160 when moved accordingly. Such relative movement is caused by force exerted on the movable member by a user adjusting control member 180, as described below. This force may be provided by any number of mechanical mechanisms; here the movable member 140 receives a moving force from a threaded engagement between the control member 180 and the second portion 142 of the movable member 140 at threads 143 (see FIGS. 21A and 25). Threads 143 of the movable member 140 are designed to remain rotationally stationary relative to the housing 110 such that rotation of the control member 180 forces the movable member to translate with respect to the housing 110. This rotational stability is provided by guide protrusions 146 (FIG. 21A) on the second portion 142 of the movable member 140. Guide protrusions 146 are received slideably in guide recesses 114 (FIG. 21B) of the first side 111 of the housing 110 such that the second portion 142 of the movable member 140 may translate but will not substantially rotate with respect to the housing 110 owing to the interface between the protrusions 146 and the recesses 114.

Further, referring to FIGS. 21A, 24, 25 and 27, the second portion 142 may include a cavity 141 that is configured to support a transducer 190, part of the cord 10 electrically coupled to the transducer 190 (see FIG. 27), and the first portion 150 of the movable member 140. The second portion 142 may also include a slot 149 for passing the cord 10 into the cavity 141. Additionally, the second portion 142 may include locking grooves 147 and transducer supports 148. The first portion 150 of the movable member 140 may include locking protrusions 152 that are designed to be inserted and twisted into the locking grooves 147 of the second portion 142 such that transducer 190 is held in place, or sandwiched, between the first portion 150 and the second portion 142 of the movable member. Friction between the first portion 150, the transducer 190, and the supports 148 of the second portion 142 may provide sufficient force to prevent the protrusions 152 of the first portion 150 from freely decoupling from the locking grooves 147 of the second portion 142. Accordingly, the movably member 140, including the first and second portions 150, 142, is designed to move as a single rigid body relative to housing 110. Thus, while shown in at least one embodiment as two separable components, first and second portions 150, 142 could also be one unitary and integral component.

The first portion 150 of the movable member 140 is designed, in at least one non-limiting embodiment, to actuate expansion assembly 160 as the first portion 150 is moved from a first position (FIG. 25) to at least a second position (FIG. 26). The first portion 150 thus includes an actuating surface 155 (see, e.g. FIG. 24) that may be shaped and positioned such that the actuating surface 155 engages operably the expansion assembly 160, as explained in more detail below. The first portion 150 of the movable member 140 also may include a sound passageway 151 (FIG. 21A) oriented along longitudinal axis L. Sound passageway 151 provides a channel along which sound produced by the transducer 190 may travel freely toward an inner end 101 (FIG. 20) of the earphone 100 and into opening 125 (FIGS. 21A-26) of the cushion 121. Also, the first portion 150 includes an O-ring groove 153 (FIG. 21A) configured to hold an elastic O-ring 154. O-ring 154 seals the movable member against the first side 111 of the housing 110 and/or against the expansion assembly 160 (see FIGS. 25-26). Accordingly, audible sound waves produced by the transducer 190 only are allowed to travel toward the inner end 101 of the earphone 100, and, subsequently, a user's ear drum, via sound passageway 151 of the movable member 140.

According at least one non-limiting embodiment, referring now to FIGS. 21A-21B and 25-26, the expansion assembly 160 is designed to expand in at least one direction when actuated by the movable member 140. The expansion assembly 160 may be designed to expand in a direction substantially transverse to the longitudinal axis L (see FIG. 20). Here, this is accomplished by using a set of cantilever arms 161. The cantilever arms 161 protrude from the first side 111 of the housing and, when the resilient cushion 121 is attached to the housing, are at least partially located within the opening 125 of the cushion 121. Arm recesses 126 (FIG. 21B) formed in the cushion 121 receive the cantilever arms 161 such that the cushion 121 does not rotate freely thereon. The cantilever arms 161 are uniformly spaced around longitudinal axis L to form an opening 164 configured to receive the first portion 150 of the movable member. Cantilever arms 161 each include an inner surface 163 and an outer surface 162. Inner surface 163 is curved at least partially toward longitudinal axis L so that at least part of the inner surface 163 will make contact with the movable member's actuating surface 155 when the movable member 140 is advanced toward the inner end 101 of the earphone 100. The actuating surface 155 of the movable member 140 is curved correspondingly to meet the inner surface 163 of each cantilever arm 161. As the movable member 140 is moved toward the inner end 101 of the earphone 100, the actuating surface 155 of the first portion 150 of the movable member 140 makes contact with one or more of the cantilever arms 161 at inner surface 163. Further movement of the movable member 140 in the same direction pushes on the inner surface 163, thus forcing the cantilever arm 161 to bend away from longitudinal axis L (see FIG. 26). Because the cantilever arms 161 are received insertably in the opening 125 of the resilient cushion 121, the cantilever arm is bent into the cushion 121 as the movable member 140 contacts and pushes the cantilever arm 161. Consequently, as the cantilever arm is continually bent away from longitudinal axis L, the cushion 121 is forced to have an expanded, second shape 123 (see FIG. 26). Thus, the ear canal portion 120 may be expanded after insertion in a user's ear canal, substantially sealing the cushion 121 against the user's ear canal to form a snug fit.

Note that, while a plurality of cantilever arms 161 are described above as providing the expansion assembly 160 with the ability to expand, it is contemplated that any number of cantilever arms, including one, could perform the same or similar function.

According at least one non-limiting embodiment, the control member 180 is designed to actuate the movable member 140 such that the movable member 140 moves to cause expansion assembly 160 to expand in at least one direction.

Control member 180 accomplishes this in any number of forms. For instance, but without limitation, control member 180 could be in the form of a push button, rotatable dial, or squeezable member. In FIGS. 20-27, for example, control member 180 is a dial 182 rotatably mounted in the housing 110. Dial 182 rotates, but does not translate with respect to housing 110. Dial 182 moves in such a fashion because it includes a protruding ring 184 (FIGS. 21A and 25) along its perimeter that slideably engages a groove 117 of the housing 110. Groove 117 is formed between a lip 113 of the second side 112, the first side 111, and cord guide 115 of housing 110 (see FIG. 25). Thus, dial 182 is rotatable about longitudinal axis L. Further, at least part of the dial may extend from the second side 112 of the housing 110 such that it is accessible to a user while ear canal portion 120 is inserted in the user's ear canal (see. FIG. 27). Grips 185 (FIG. 21A) or another textured surface of the dial 182 may provide an enhanced user interface as the user rotates the dial with his or her fingers.

Figure 21A:
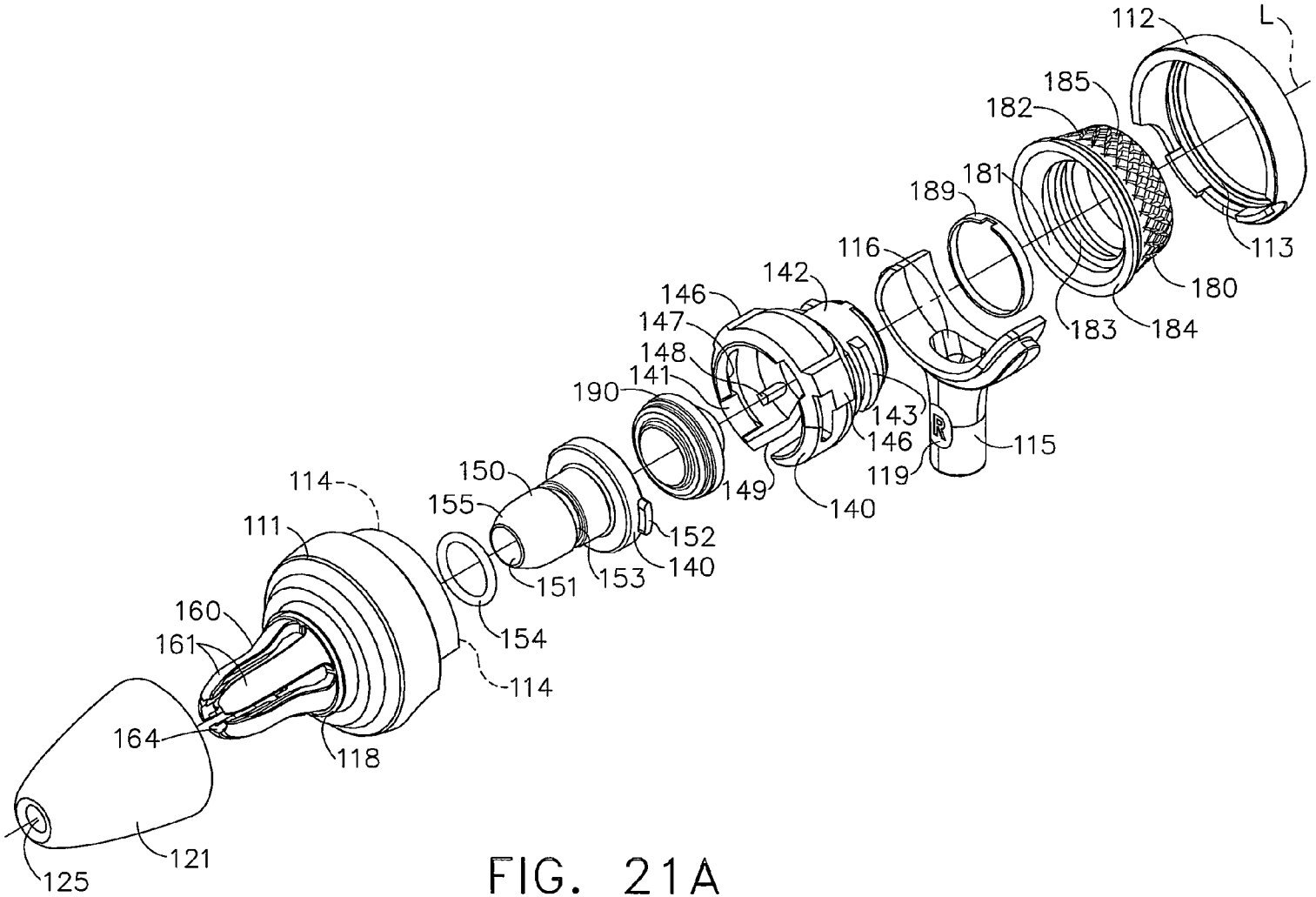
FIG. 21A is an exploded view of the adjustable earphone of FIG. 21A.
Figure 21B:
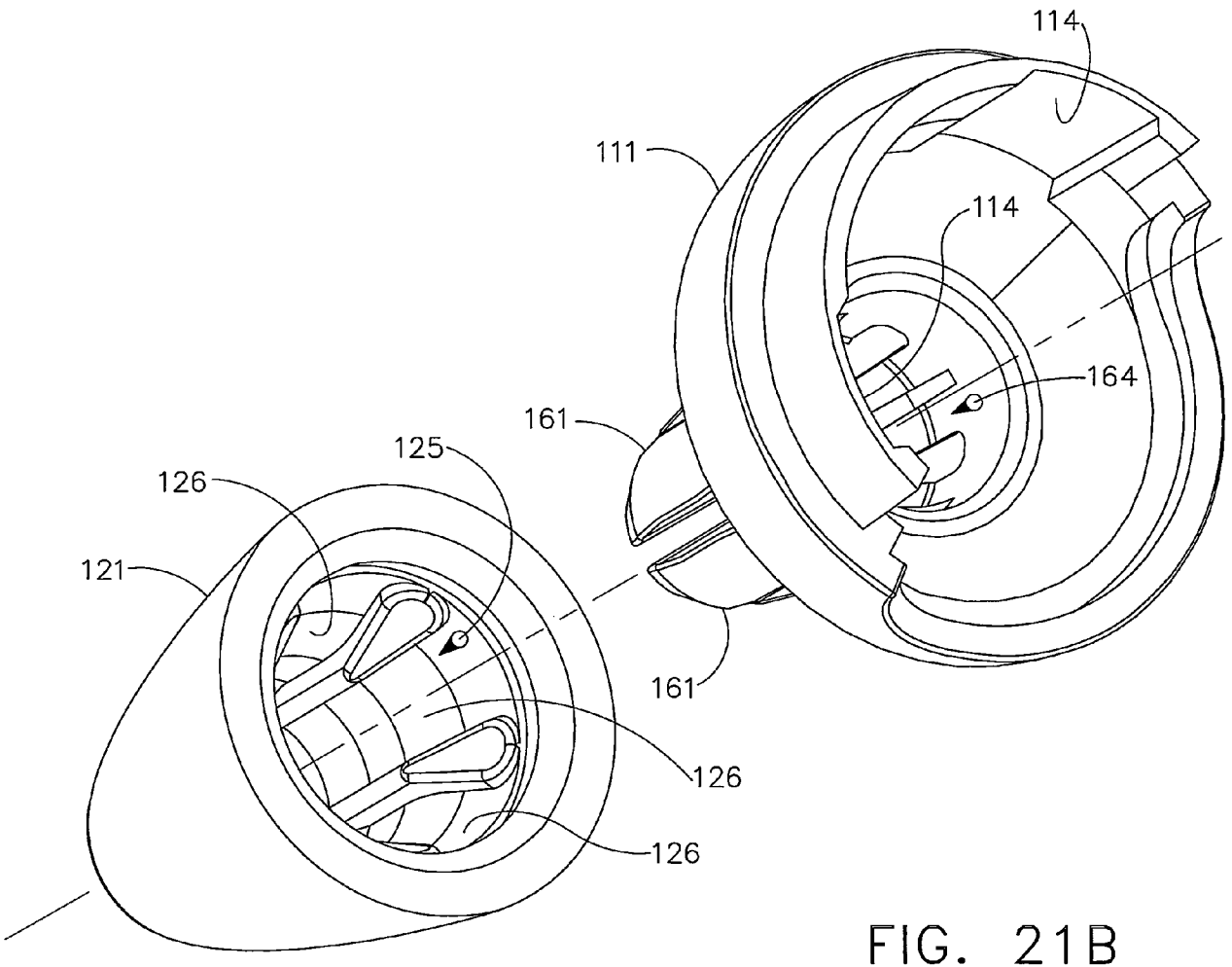
FIG. 21B is an exploded view of an ear canal cushion and part of a housing of the adjustable earphone of FIG. 21A.
Figure 22:
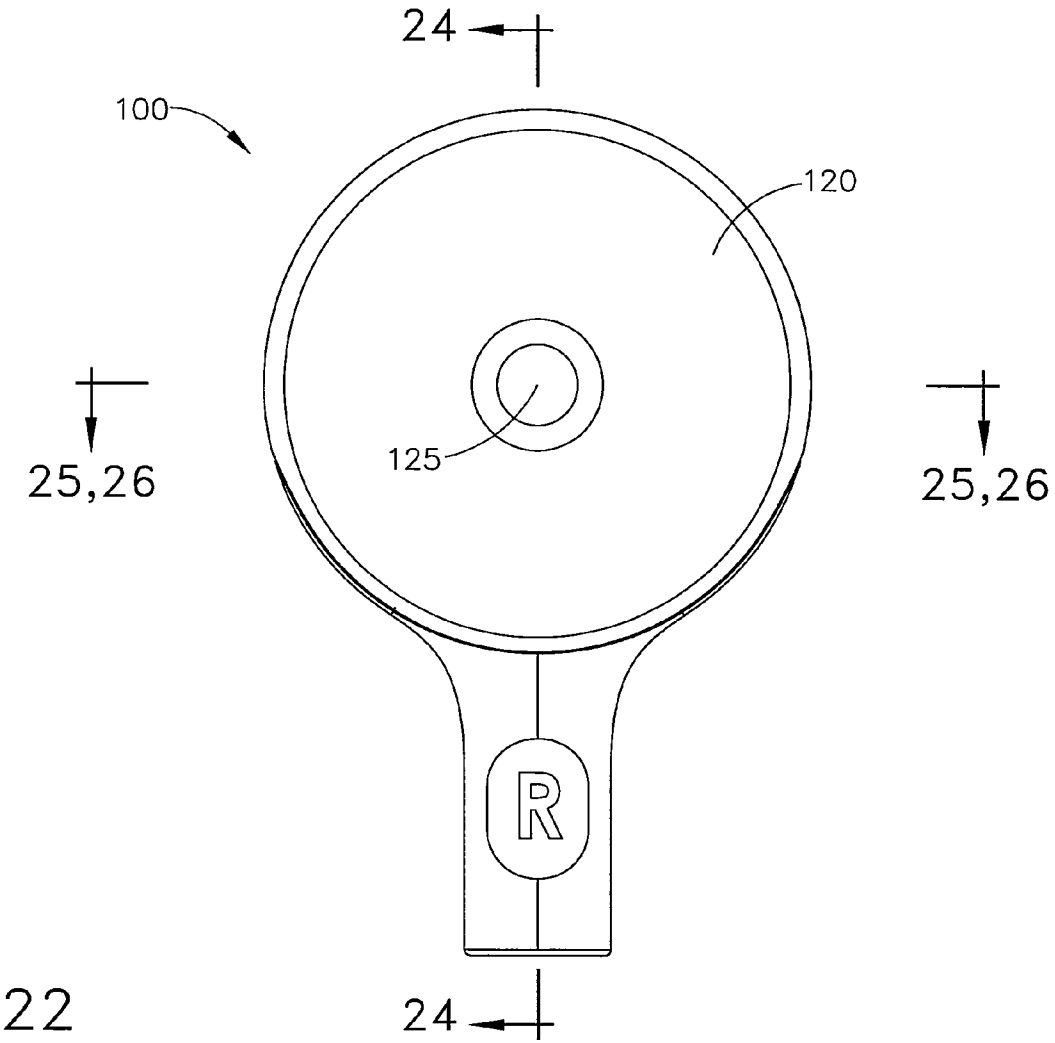
FIG. 22 is a front view of the adjustable earphone of FIG. 21A.
Figure 23:
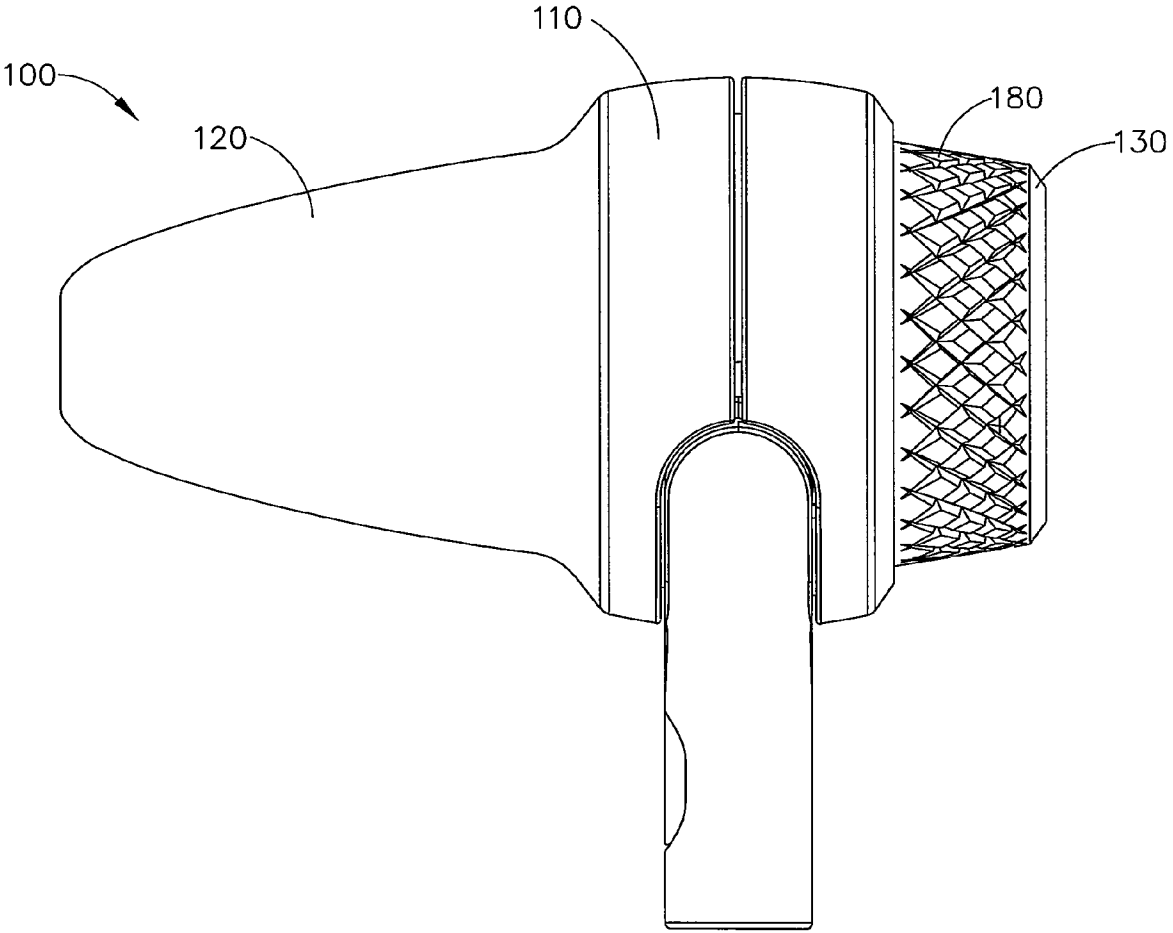
FIG. 23 is a side view of the adjustable earphone of FIG. 21A.
Figure 25:
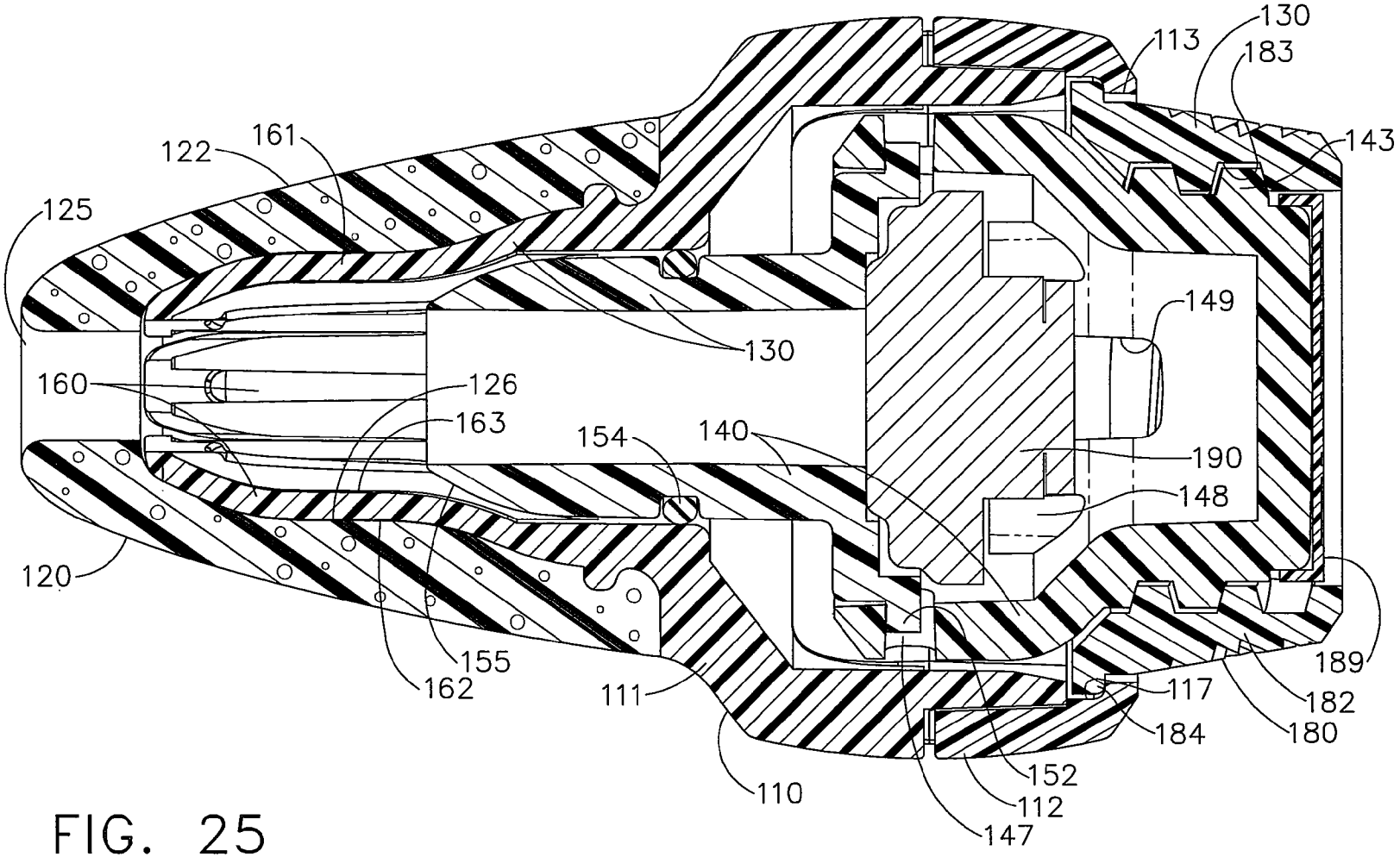
FIG. 25 is a top cross-sectional view, taken along line 25-25 in FIG. 22, of the adjustable earphone of FIG. 21A, with an ear canal portion shown having a compact, first shape.

Referring to FIGS. 21A and 25, dial 182 may include a cavity 181 for insertably receiving the second portion 142 of the movable member. Further, the dial may have threads 183 formed in the inside of the dial, facing cavity 181. The threads 183 are configured to operably engage the threads 143 formed on the surface of the second portion 142 of the movable member 140. Thus, rotation of the dial 182 rotates dial threads 183, resulting in a translational force being applied to the movable member 140 via movable member threads 143. The translational force causes the movable member to move either forward, toward the inner end 101 of the earphone 100, or backward, toward an outer end 102, depending on the direction dial 182 is being rotated. Thus, the actuator or movable member threads 143 operably engage the dial threads 183 such that rotation of the dial 182 in a first direction translates the rigid actuator into contact or additional contact with each cantilever arm 161 (see FIGS. 25-26).

Figure 24:
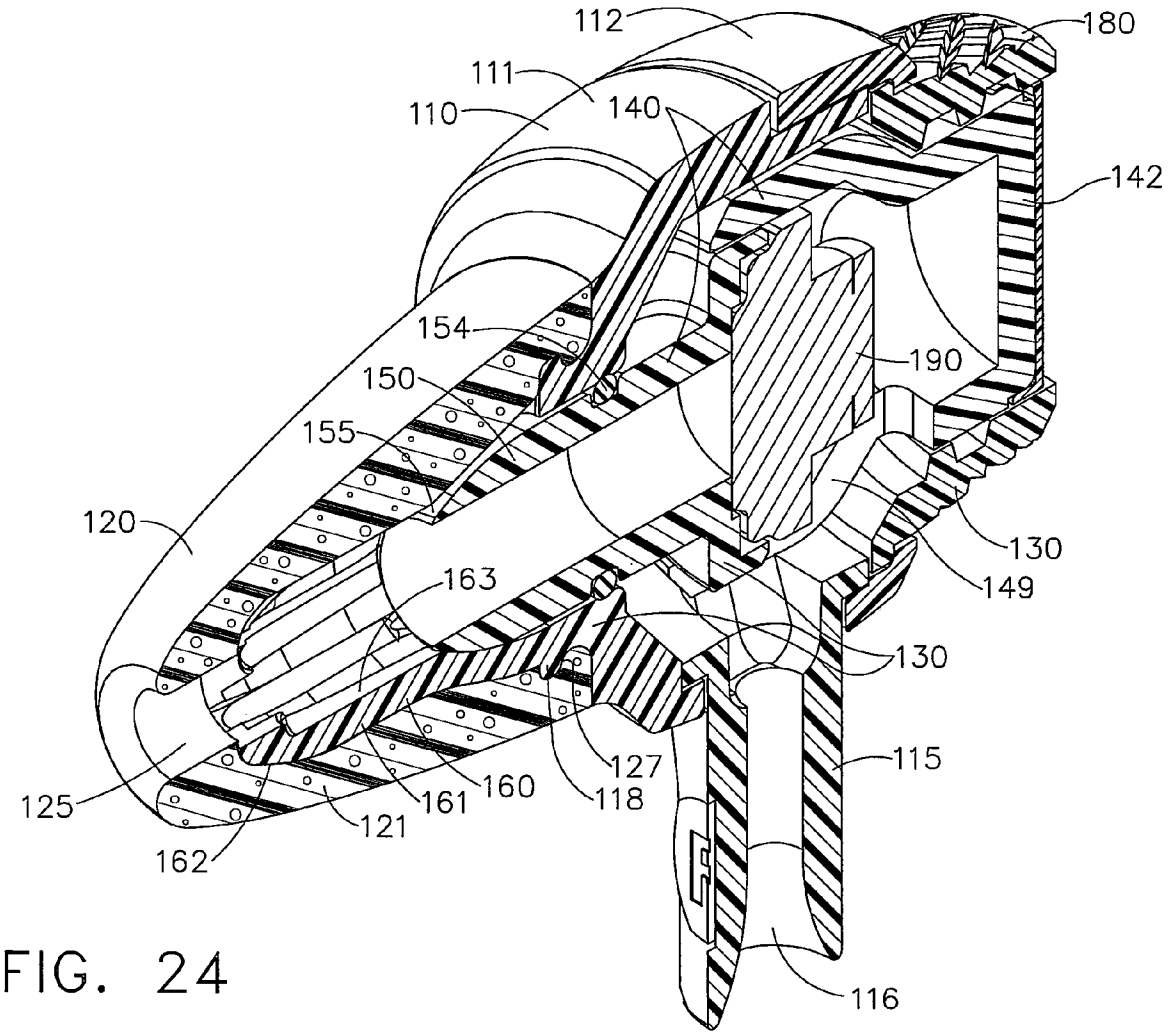
FIG. 24 is a perspective cross-sectional view, taken along line 24-24 in FIG. 22, of the adjustable earphone of FIG. 21A.

Focusing now on the other elements of earphone 100, the housing 110 may be adapted to receive a number of components, including a transducer 190. Also, cord 10 (FIGS. 18B and 27) is received in the housing 110 through cord passageway 116 of cord guide 115 (see FIG. 24). Cord guide 115 may also include a marking 119 to indicate in which ear, for example right ("R," as seen in FIG. 21A) or left ("L," not shown), a user should place the earphone 100. Cord 10 provides an electrical conduit between the electrical connector 13 and the transducer 190; part of the cord 10 may be electrically coupled to the transducer 190, for instance, an interior wire of cord 10 may be soldered to the transducer 190 (see FIG. 27). Transducer 190 is capable of producing audible signals, or sound, in response to electrical signals received by the transducer 190 from the electrical connector 13 via cord 10. To prevent undesired stress from being transferred to the transducer, the cord 10 may be tied to form a knot (FIG. 27) at the cord's second end 12 (FIG. 18B). This knot is received within the cavity 141 of the second portion 142 of the movable member 140 and is sized such that it is larger than the width of slot 149 (FIG. 24). Therefore, if a user pulls on cord 10, the knot is forced against the second portion 142 at slot 149 and the knot absorbs the stress created by such pulling, thereby shielding the transducer from unnecessary stress and/or strain.

Further, the second portion 142 of the movable member 140 may have a manufacturer's logo piece 189 positioned near the outer end 102 of the earphone 100 (see FIGS. 1A, 20, 21A and 25). Logo piece 189 is press fit to the second portion 142 such that it is visible through dial 182 at the outer end 102. The logo piece 182 is kept in a desired position, for example, approximately horizontal, when the cord 10 is hanging in a downward direction from a user's ear, for example similar to the orientation shown in FIG. 27. The logo piece 189 is kept in such a position because the logo piece 189 is secured to the non-rotating movable member 140 at second portion 142. While the logo 189 may translate with the movable member 140, it will not rotate with dial 182; therefore, it is prevented from rotating such that an observer easily may read the manufacturer's logo regardless of the rotation of dial 182.

The foregoing has focused on at least one embodiment for adjusting the shape of an eartip, or an ear canal portion, of an earphone while inserted in a user's ear canal. However, various embodiments are possible to accomplish the same or similar goal. As illustrated in FIGS. 2A-2E, expansion of the eartip 220 may be achieved in several ways. In a first embodiment (see FIG. 2A), where the eartip 220 is in a compact configuration 222 when unmodified, inner and outer sides 227, 228 of the eartip may be brought together to compress the material of the eartip 220, causing it to expand into an expanded configuration 223. In a second embodiment (see FIG. 2B), where the eartip 320 is in an expanded configuration 323 while unmodified, inner and outer sides 327, 328 of the eartip 320 may be pulled apart from each other to stretch the material of the eartip, causing it to change into a compact configuration 322. In a third embodiment (see FIG. 2C), where the eartip 420 is in a compact configuration 422 when unmodified, an outer portion 428 of the eartip may be squeezed, displacing eartip material into remaining portions of the eartip 420, causing the remaining portions to expand into an expanded configuration 423. In a fourth embodiment (see FIG. 2D), where the eartip is in a compact configuration 522 when unmodified, one or more elements of the earbud that are located inside the eartip (for example, a cantilever arm or arms 161, as described above and seen in FIGS. 21A-21B and 24-27) may push outwards on the eartip, causing it to expand into an expanded configuration 523. In a fifth embodiment (see FIG. 2E), where the eartip 620 is in an expanded configuration 623 when unmodified, one or more elements of the earbud that are located inside the eartip 620 may pull inwards on the eartip 620, causing it to change into a compact configuration 622.

Figure 3A:
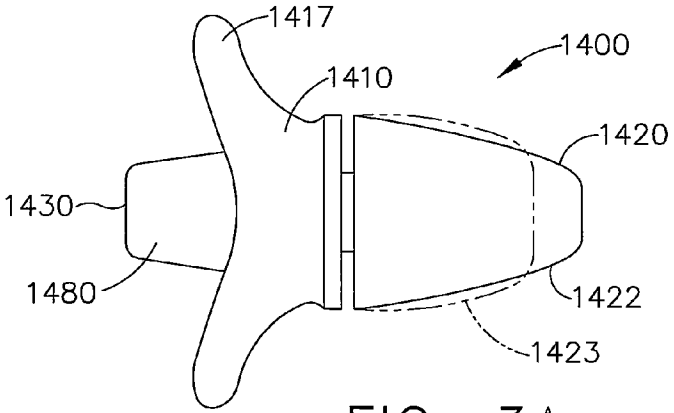
FIGS. 3A-3D are several top views of adjustable earphones using a variety of user controls and actuator mechanisms to provide an adjustable earphone according to various embodiments.

As illustrated in FIGS. 3A-3D, a variety of user controls and actuator mechanisms may be utilized to provide an earbud, or earphone, according to various non-limiting aspects of the present disclosure. For example, referring to FIG. 3A, an earphone 1400 may include an adjustment assembly 1430 that may include a control member 1480 in the form of a pressable button. The control member 1480 may also be operable with finger grips 1417 protruding from a housing 1410 of the earphone 1400 such that a user may grip the finger grips 1417 and press the button, or control member 1480, without forcing the earphone 1400 excessively into an ear canal of the user. Depressing the button, or control member 1480, may cause an ear canal portion 1420 extending from a housing 1410 to transition from a first shape 1422 to a second shape 1423. Alternatively, referring now to FIG. 3D, an earphone 1600 may include an adjustment assembly 1630 that may include a control member 1680 also in the form of a pressable button. However, in the earphone 1600 of FIG. 3D, the finger grips shown in FIG. 3A are omitted. Depressing the button, or control member 1680, may cause an ear canal portion 1620 extending from a housing 1610 to transition from a first shape 1622 to a second shape 1623.

Figure 28:
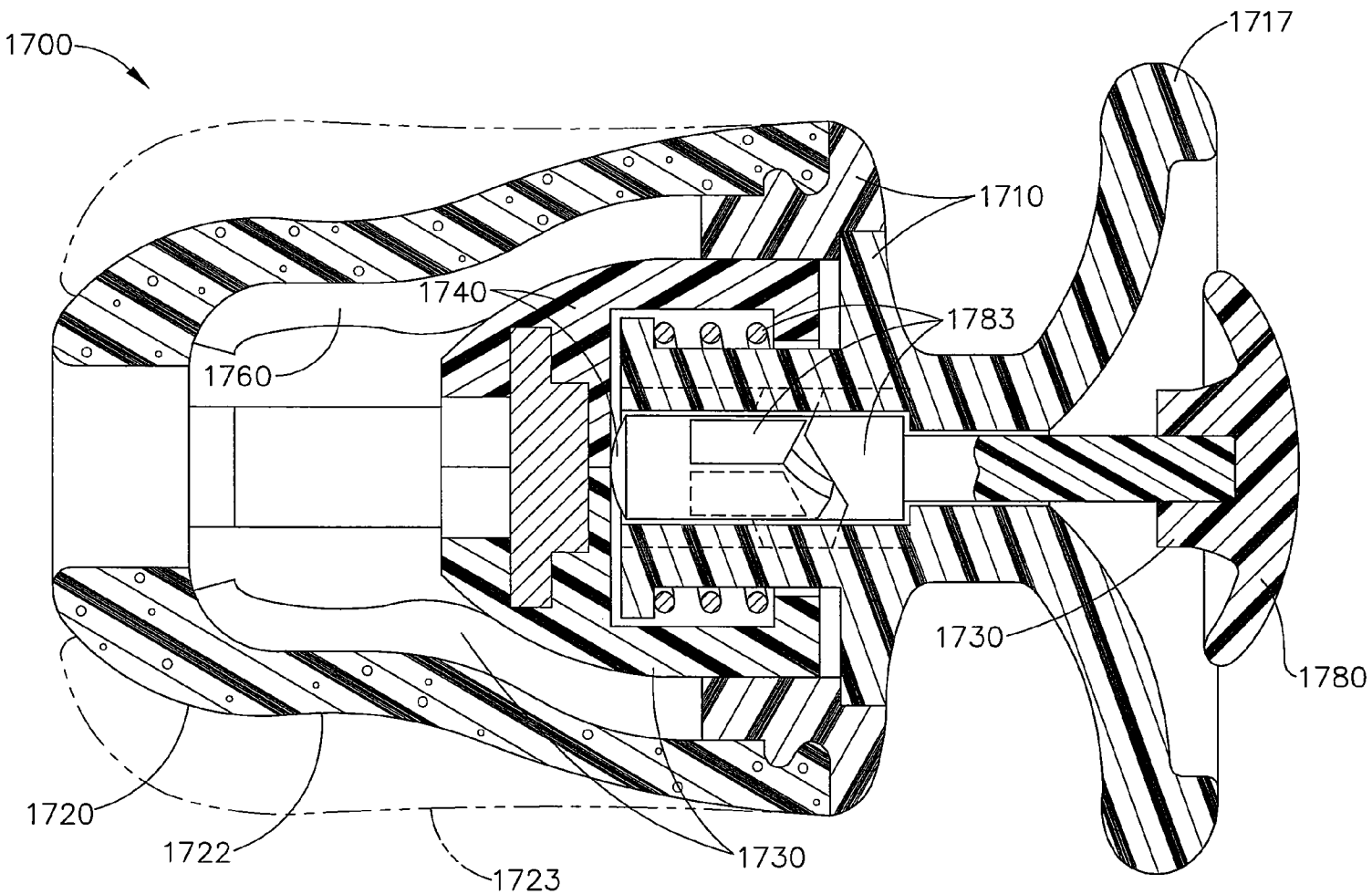
FIG. 28 is a top cross-sectional view of one non-limiting embodiment of an adjustable earphone having a push button.

In more detail, an earphone 1700 with a pressable button as control member 1780 is shown in FIG. 28. The control member 1780 is part of an adjustment assembly 1730 that includes a movable member 1740 and an expansion assembly 1760.

Earphone 1700 is similar to earphone 1400 described above in that it also has finger grips 1717 protruding from a housing 1710 such that a user may grip the ginger grips and press the button, or control member 1780, without forcing the earphone 1700 and ear canal portion 1720 excessively into an ear canal of the user. Depressing the button, or control member 1780 causes a movable member 1740 to move and actuate expansion assembly 1760. Thus, depressing the button, or control member 1780, may cause an ear canal portion 1720 extending from a housing 1710 to transition from a first shape 1722 to a second shape 1723. Movable member 1740, expansion assembly 1760, and ear canal portion 1720 are similar to movable member 140 and expansion assembly 160 described above and seen in FIGS. 25-26, for example. The control member 1780 includes a protract-retract assembly 1783 operable to hold the movable member 1740 in the first position shown in FIG. 28 before the button, or control member 1780, is initially pressed and, after pressing the button, operable to hold the movable member in a second position (not shown) correlating with expansion of the expansion assembly 1760 and transition of the first shape 1722 to a second shape 1723. Protract-retract assembly 1783 may be similar to that used with a traditional retractable ballpoint pen including a spring and cam arrangement and is described, for example, in U.S. Pat. No. 3,819,282 to Schultz titled RETRACTABLE PEN, hereby incorporated by reference in its entirety.

Figure 3B:
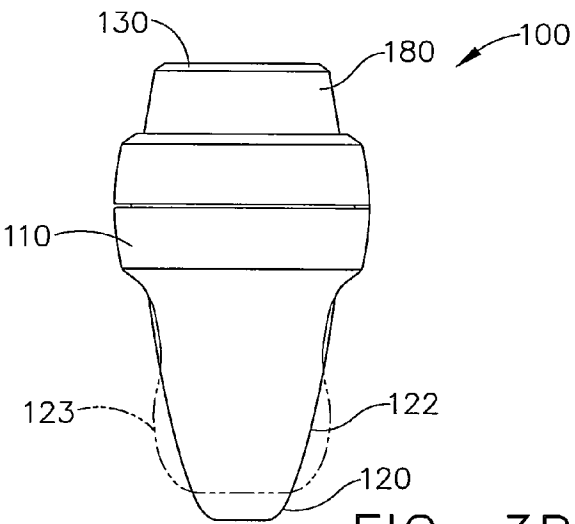

Further, referring now to FIG. 3B, and as discussed above, an earphone 100 may include an adjustment assembly 130 including a control member 180 in the form of a rotatable dial. Rotating the dial, or control member 180, may cause an ear canal portion 120 extending from a housing 110 to transition from a first shape 122 to a second shape 123.

Figure 3C:
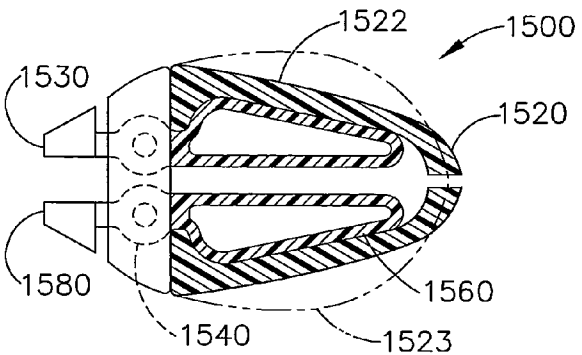
Figure 3D:
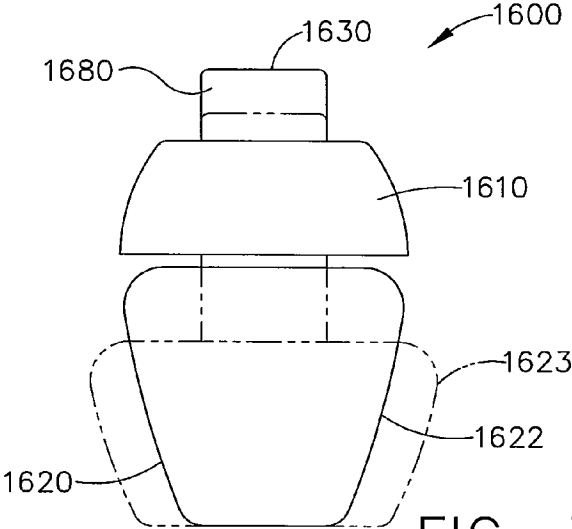

Another non-limiting example of a user control and actuator mechanism is provided by reference to FIG. 3C. An earphone 1500 may include an adjustment assembly 1530 including a squeezeable control member 1580 operable to rotate a movable member 1540 such that an expansion assembly 1560 presses outward on an ear canal portion 1520 extending from a housing. Squeezing the control member 1580 causes the ear canal portion 1520 to transition from a first shape 1522 to a second shape 1523.

In any event, according to various non-limiting embodiments of an adjustable earphone, a user control, or control member, is capable of being manipulated by a user while an eartip, or ear canal portion, of the earphone is positioned in the user's ear canal. In response to such manipulation of the control member, the ear canal portion is designed to change shape such that the ear canal portion fits snugly against the ear canal.

Unless otherwise indicated herein, an earbud, or earphone, according to an aspect of the present disclosure has an inner end with an eartip, or ear canal portion, that is placed within the ear canal of a user and an outer end with a control feature, or control member, that remains outside the ear canal and may be accessed by the user to expand or compact the eartip, or ear canal portion.

Figure 4:
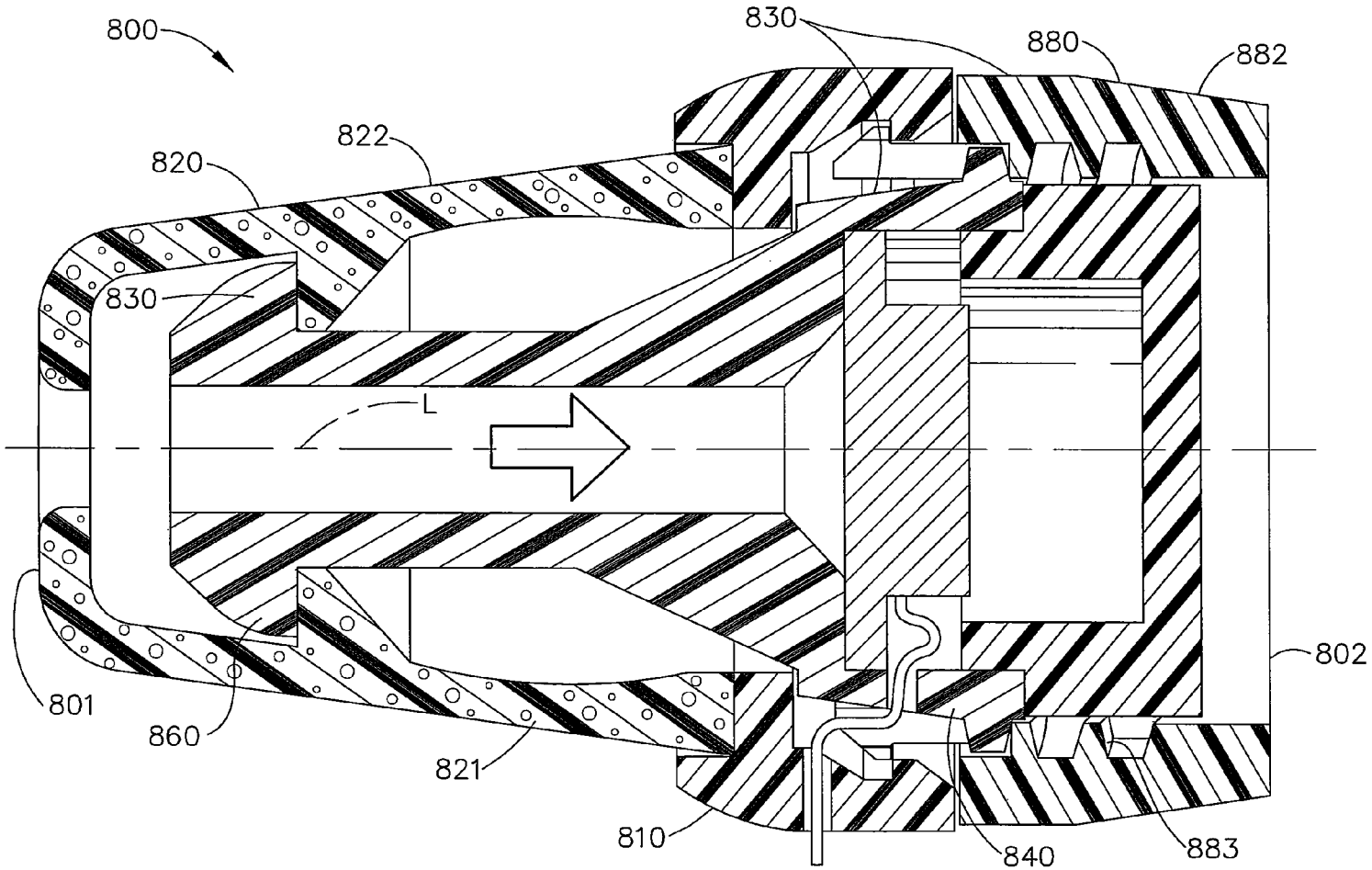
FIG. 4 is a side cross-sectional view of one non-limiting embodiment of an adjustable earphone.
Figure 6:
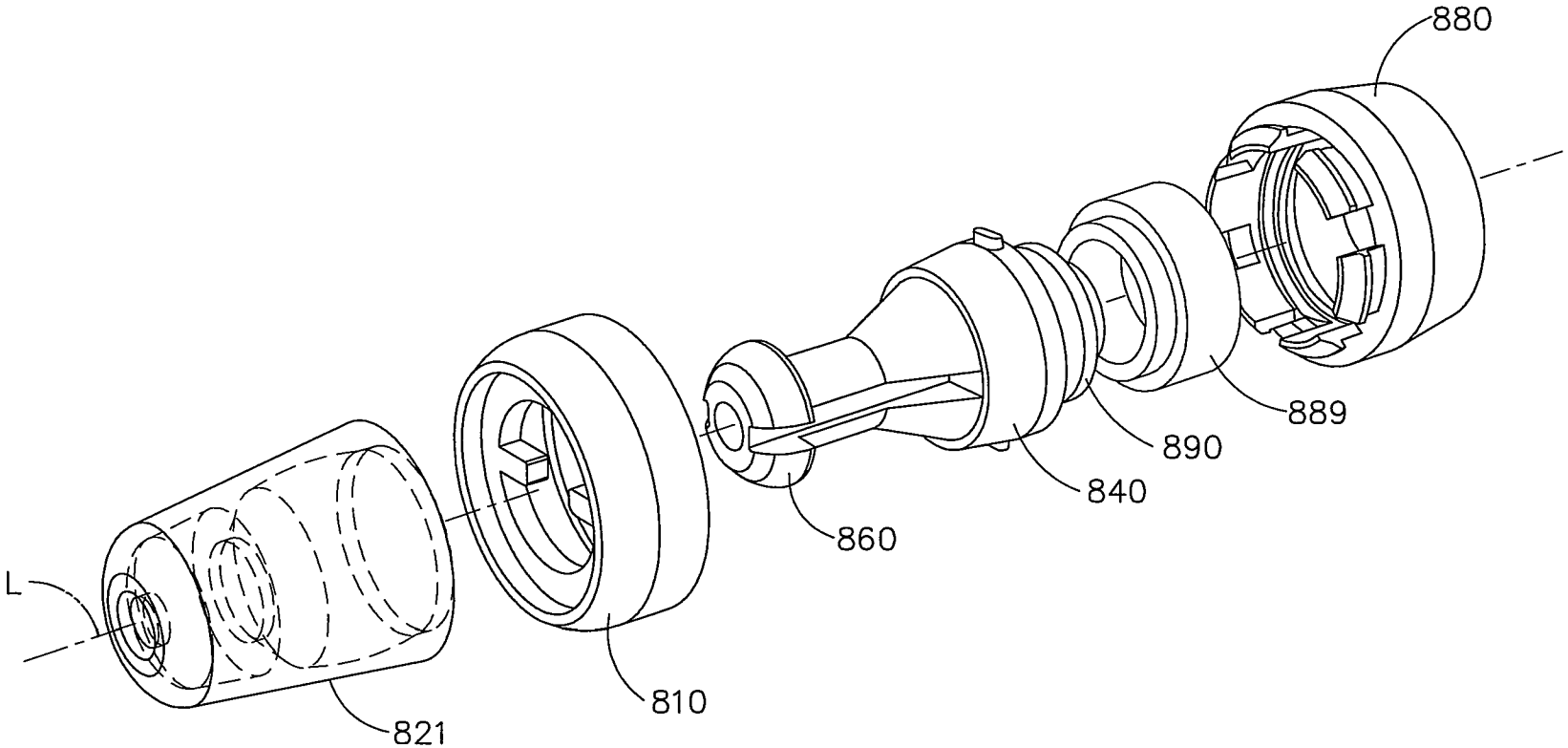
FIG. 6 is an exploded view of the adjustable earphone of FIG. 4.

In various embodiments, referring to FIGS. 4-6, an adjustable earphone 800 may include another means for adjusting the shape of an ear canal portion 820 having a first shape 822 (FIGS. 4, 5C, and 5E) by a user when the ear canal portion 820 is positioned in the user's ear canal. Means for adjusting the shape of the ear canal portion 820 may be provided in at least one embodiment by adjustment assembly 830. Adjustment assembly 830 may be operably coupled to housing 810 and/or to the ear canal portion 820 such that actuation of the adjustment assembly 830 causes the ear canal portion 820 to have a second shape 823 (FIGS. 5D and 5G) and may also cause ear canal portion 820 to have at least an intermediate, third shape 824 (FIG. 5F).

As seen at least in FIGS. 4 and/or 6, adjustment assembly 830 may include a movable member 840, an expansion assembly 860, and a control member 880. The control member 880 may include a rotatable adjustment dial 882. Further, the ear canal portion 820 may include a cushion 821. Positioned at least partially within the housing 810 are a transducer 890 and a manufacturer logo piece 889. A cord is coupled to the transducer 890 (see FIG. 4) such that electrical signals can be passed to the transducer 890 to create audible sound therefrom.

Thus, FIGS. 4-6 depict an earphone or earbud 800, according to an aspect of the present disclosure, where rotation of an adjustment dial 882 having an internal thread 883 and located at an outer end 802 of the earbud 800 pulls a movable member, or actuator 840, coupled to an ear canal portion, or eartip 820, at an inner end 801 of the earbud 800, with the result that the eartip 820 is compressed along an axis L running from the outer end 802 to the inner end 801 of the earbud 800, causing it to expand radially away from the axis L.

Figure 7:
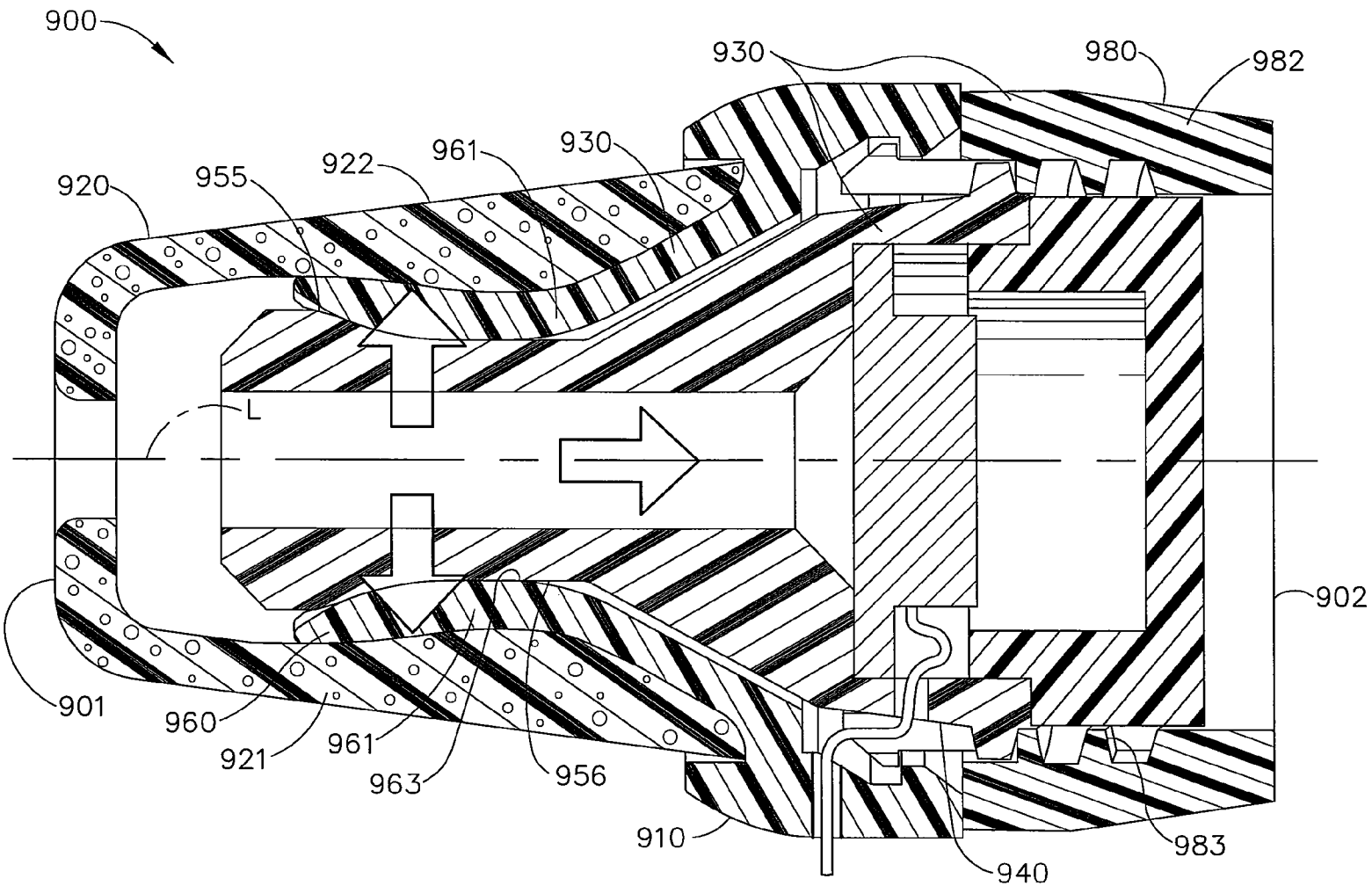
FIG. 7 is a side cross-sectional view of one non-limiting embodiment of an adjustable earphone.
Figure 9:
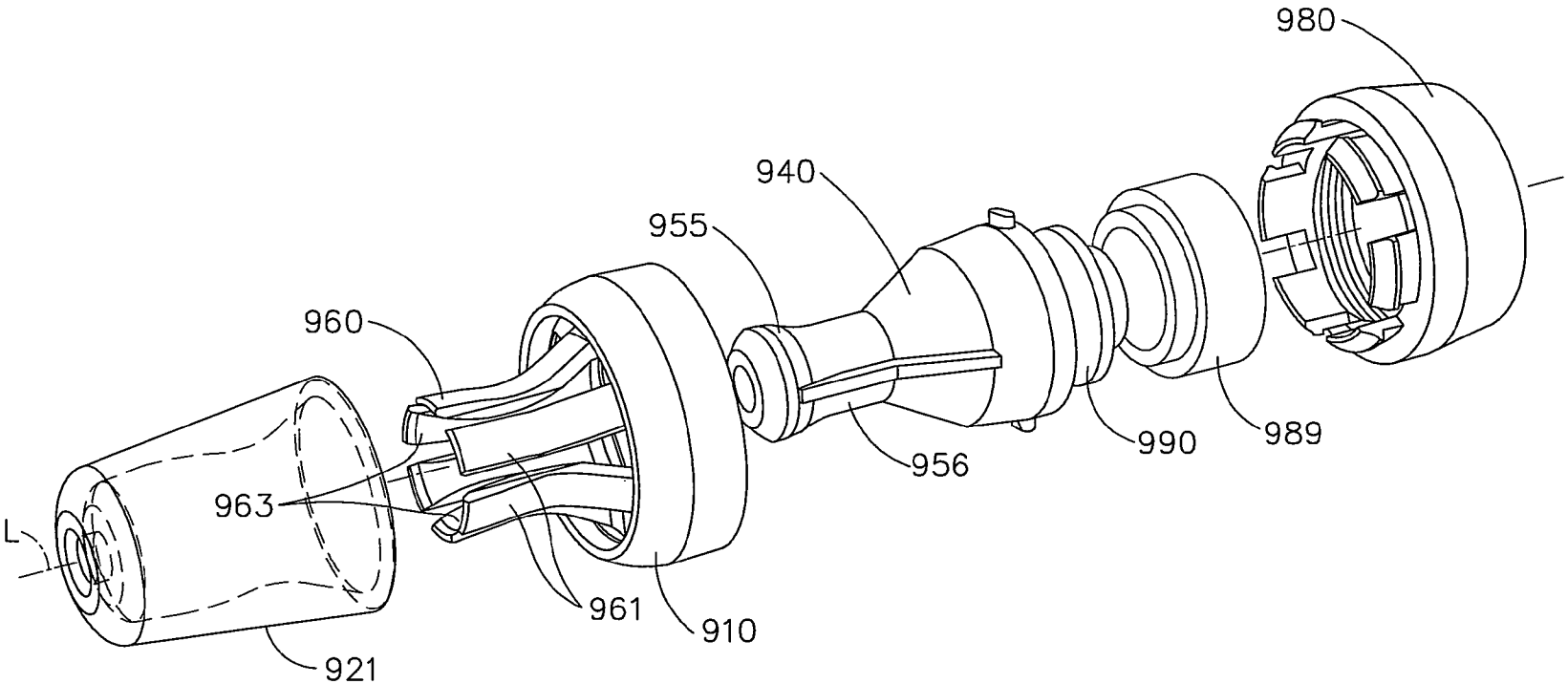
FIG. 9 is an exploded view of the adjustable earphone of FIG. 7.

In various embodiments, referring to FIGS. 7-9, an adjustable earphone 900 may include another means for adjusting the shape of an ear canal portion 920 having a first shape 922 (FIGS. 7 and 8A), 922*a* (FIG. 8D), or 922*b* (FIG. 8F) by a user when the ear canal portion 920 is positioned in the user's ear canal. Means for adjusting the shape of the ear canal portion 920 may be provided in at least one embodiment by adjustment assembly 930. Adjustment assembly 930 may be operably coupled to housing 910 and/or to the ear canal portion 920 such that actuation of the adjustment assembly 930 causes the ear canal portion 920 to have a second shape 923, (FIG. 8A), 923*a* (FIG. 8E), or 923*b* (FIG. 8G). The first and second shapes shown in FIGS. 7-8G (922, 922*a*, and 922*b*, and 923, 923*a*, and 923*b*) are dependent on the relative size, shape, and placement of the various components of the earphone 900 including, but not limited to, the expansion assembly 960, the movable member 940, and the ear canal portion 920.

As seen at least in FIGS. 7 and/or 9, adjustment assembly 930 may include a movable member 940, a expansion assembly 960, and a control member 980. The control member 980 may include a rotatable adjustment dial 982. Further, the ear canal portion 920 may include a cushion 921. Positioned at least partially within the housing 910 are a transducer 990 and a manufacturer logo piece 989. A cord is coupled to the transducer 990 (see FIG. 7) such that electrical signals can be passed to the transducer 990 to create audible sound therefrom.

Thus, FIGS. 7-9 illustrate another earbud 900, according to an aspect of the present disclosure, where rotation of an adjustment dial 982 having an internal thread 983 and located at an outer end 901 of the earbud 900 pulls a movable member, or first element 940, of an adjustment assembly, or actuator assembly 930, toward the outer end 902 of the earbud 900. The first element 940 is tapered along its length, having a narrower portion 956 and a wider portion 955. An expansion assembly, or second element 960, of the actuator assembly 930 is positioned between the first element 940 and the eartip 920. The second element 960 is similar to the expansion assembly 160 including cantilever arms 161 described above (see, e.g., FIGS. 21A-21B and 24-26). The second element 960 has a plurality of portions 961 extending from an outer end to an inner end of the second element 960. In a compact configuration, inner surfaces 963 of the plurality of portions 961 of the second element 960 are in contact with the narrower portion 956 of the first element 940. As the first element 940 moves toward the outer end 902 of the earbud 900, the wider portion 955 of the first element 940 is pulled into contact with the inner surfaces 963 of the plurality of portions 961 of the second element 960, causing the plurality of portions 961 of the second element 960 to push outward and expand the eartip 920.

Figure 10:
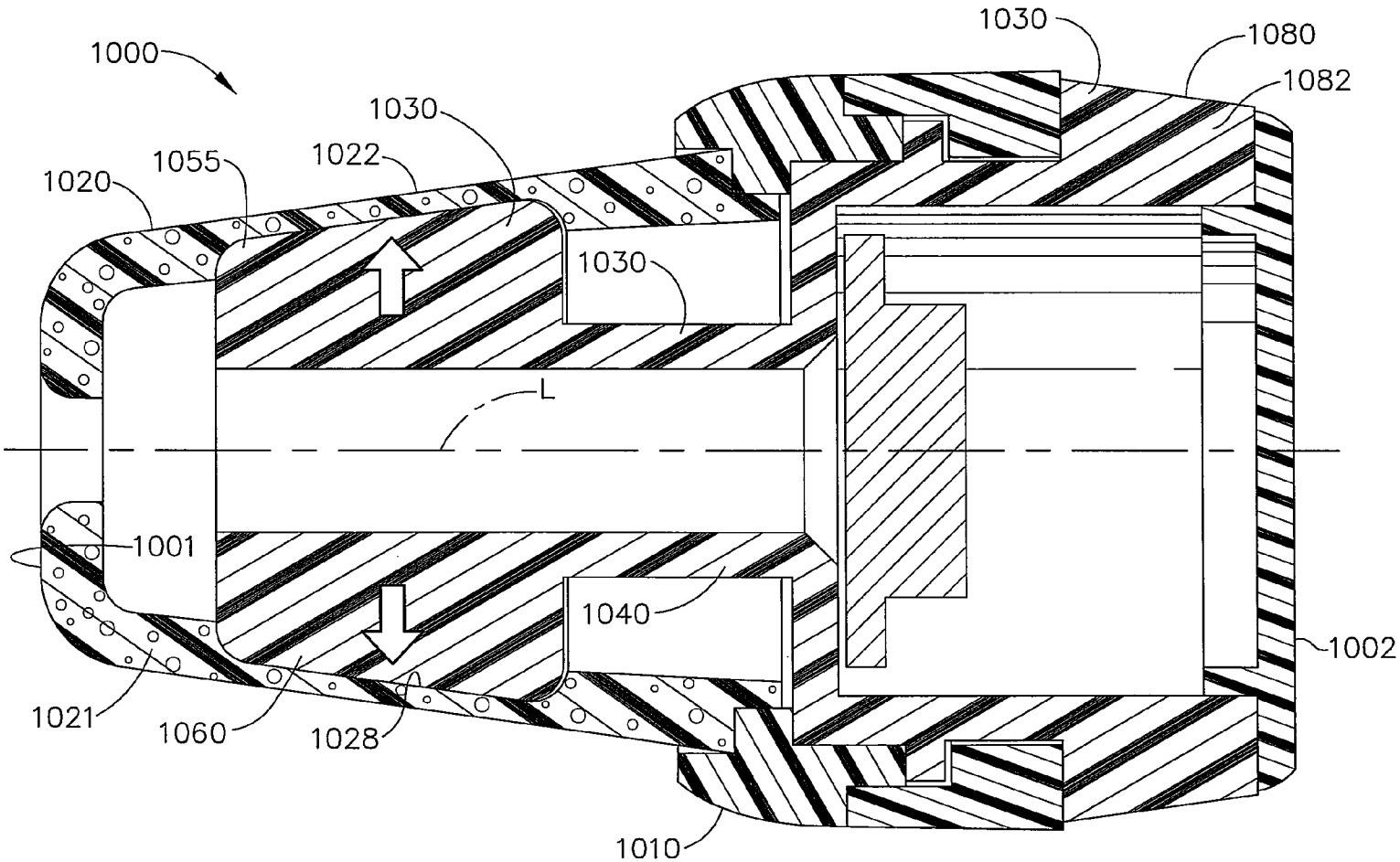
FIG. 10 is a top cross-sectional view of one non-limiting embodiment of an adjustable earphone.
Figure 11A:
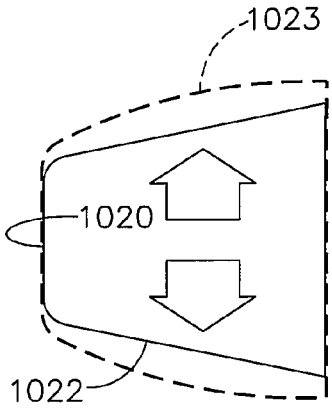
Figure 11B:
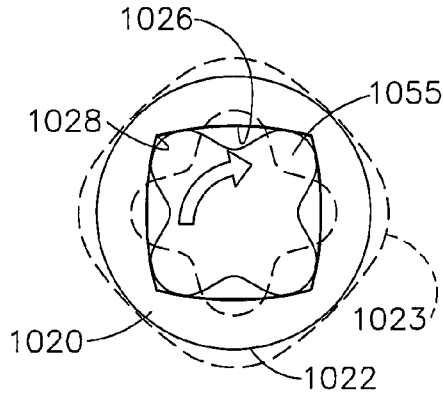
Figure 11C:
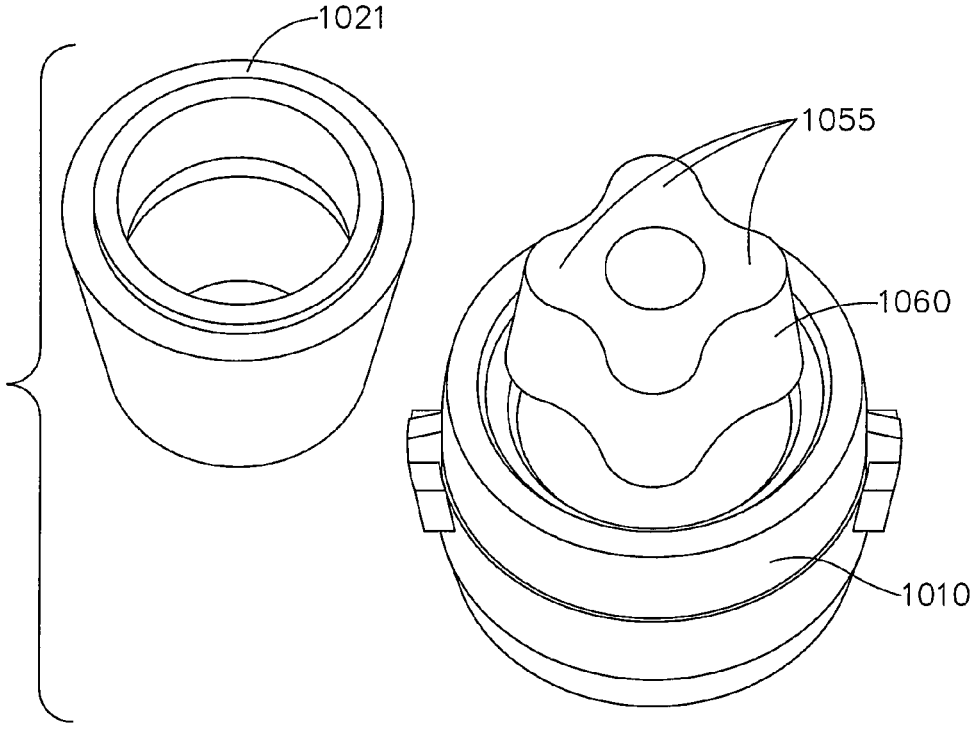
Figure 12:
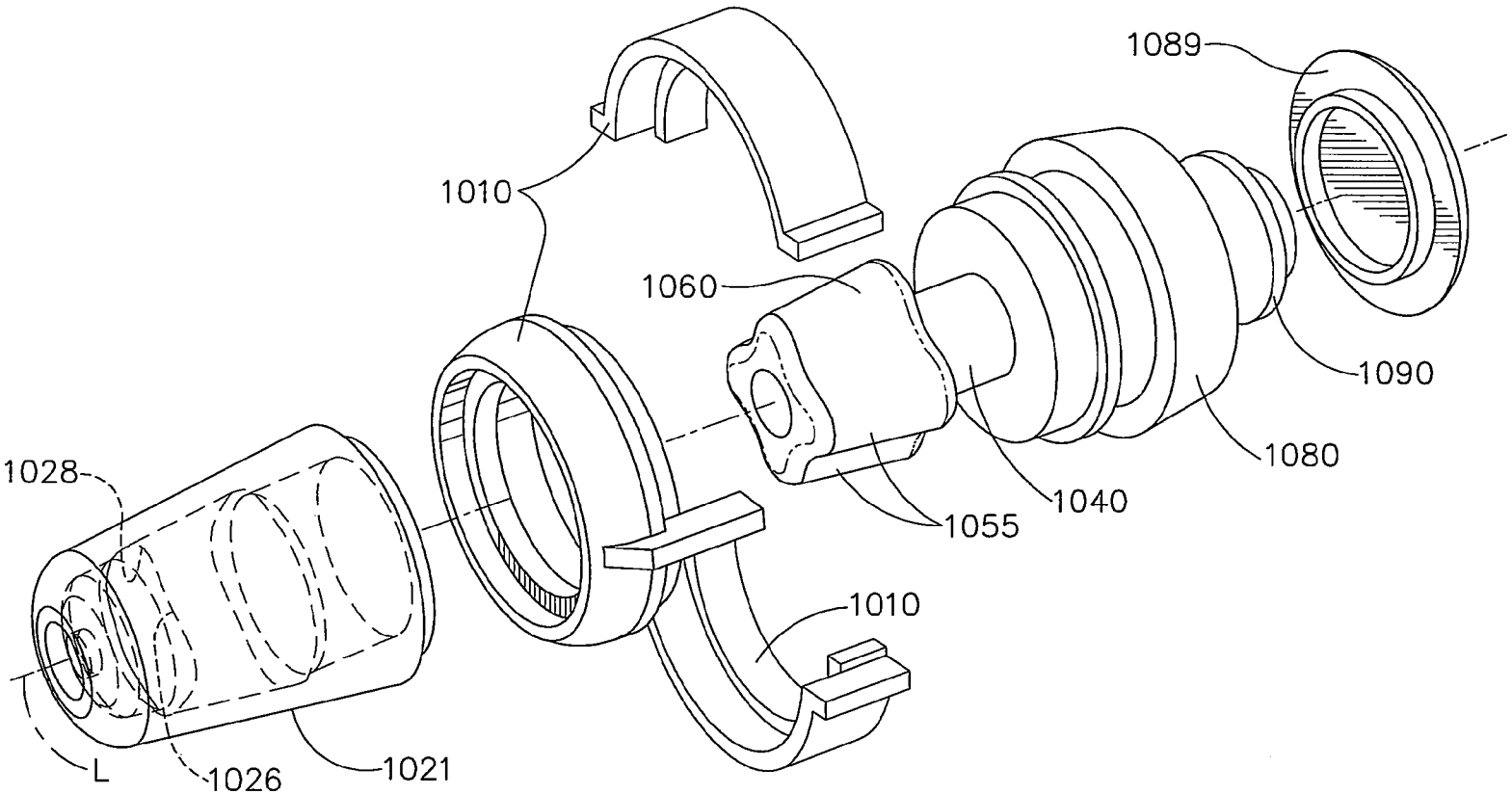
FIG. 12 is an exploded view of the adjustable earphone of FIG. 10.

In various embodiments, referring to FIGS. 10-12, an adjustable earphone 1000 may include another means for adjusting the shape of the ear canal portion 1020 having a first shape 1022 (FIGS. 10, 11A-11B, and 11E) by a user when the ear canal portion is positioned in the user's ear canal. Means for adjusting the shape of the ear canal portion may be provided in at least one embodiment by adjustment assembly 1030. Adjustment assembly 1030 may be operably coupled to housing 1010 and/or to the ear canal portion 1020 such that actuation of the adjustment assembly 1030 causes the ear canal portion 1020 to have at least a second shape 1023 (FIGS. 11A-11B and 11F).

As seen at least in FIGS. 10 and/or 12, adjustment assembly 1030 may include a movable member 1040, a expansion assembly 1060, and a control member 1080 that are formed as one unitary and integral component. Further, the ear canal portion 1020 may include a cushion 1021. Positioned at least partially within the housing 1010 are a transducer 1090 and a manufacturer logo piece 1089. A cord (not shown) is coupled to the transducer 1090 such that electrical signals can be passed to the transducer 1090 to create audible sound therefrom.

Thus, FIGS. 10-12 show yet another earbud 1000 according to an aspect of the present disclosure, having an ear canal portion, or eartip 1020, with an interior having a plurality of radially inward-extending lobes 1026 and a movable member, or actuator 1040, with corresponding radially outward-extending lobes 1055 that form at least part of expansion assembly 1060. An outer end of the actuator 1040 forms a control member 1080 that may be rotated by a user. In a compact configuration, the lobes 1055 of the actuator 1040 are located in gaps 1028 between the lobes 1026 of the eartip 1020. When the user rotates the actuator 1040 via control member 1080, the outward-extending lobes 1055 of the actuator 1040 press against the inward-extending lobes 1026 of the eartip, pushing outward on the inner surface of the eartip 1020 and causing the eartip 1020 to expand. The number of outward extending lobes of the actuator and/or expansion assembly may vary, for example, four lobes 1055 of expansion assembly 1060 are shown at least in FIG. 11C, whereas two lobes 1055*a* or an expansion assembly 1060*a* are shown at least in FIG. 11D. The cushion of eartip 1020 is correspondingly formed for the number of respective expansion assembly lobes, for instance cushion 1021 (FIG. 11C) and cushion 1021 a (FIG. 11D) may be formed for expansion assembly 1060 and expansion assembly 1060*a*, respectively. The first and second shapes of the eartip 1020 shown in FIGS. 10 and 11A-11H are dependent on the size, shape, and placement of the various components of the earphone 1000. Adjusting the number of lobes, as explained above, can also provide different first and second shapes (1022 and 1022*a*, and 1023 and 1023*a*, respectively) of the ear canal portion 1020.

Figure 13:
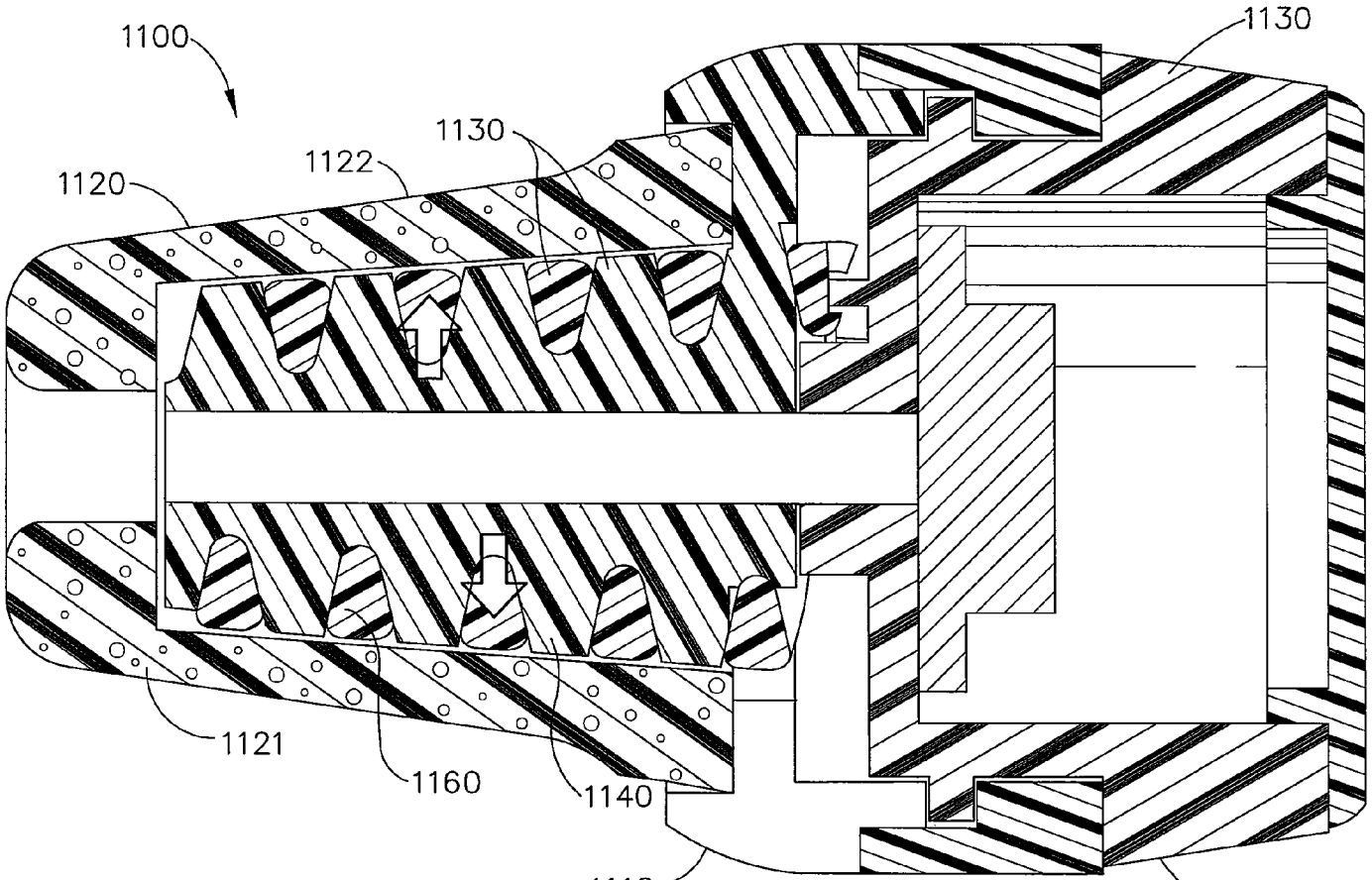
FIG. 13 is a top cross-sectional view of one non-limiting embodiment of an adjustable earphone.
Figure 14A:
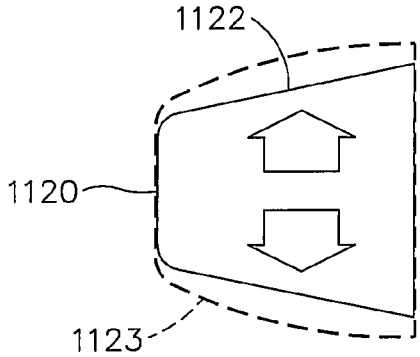
FIGS. 14A-14C are several illustrations of some of the various ear canal portion shapes made possible by the adjustable earphone of FIG. 13.
Figure 14B:
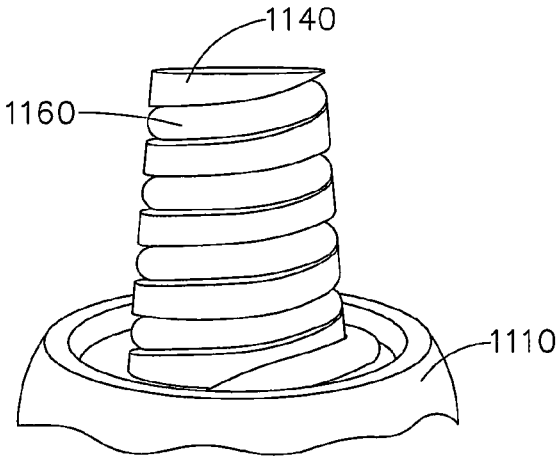
Figure 14C:
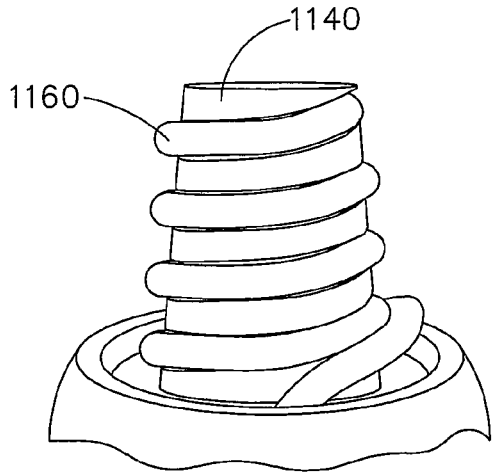
Figure 15:
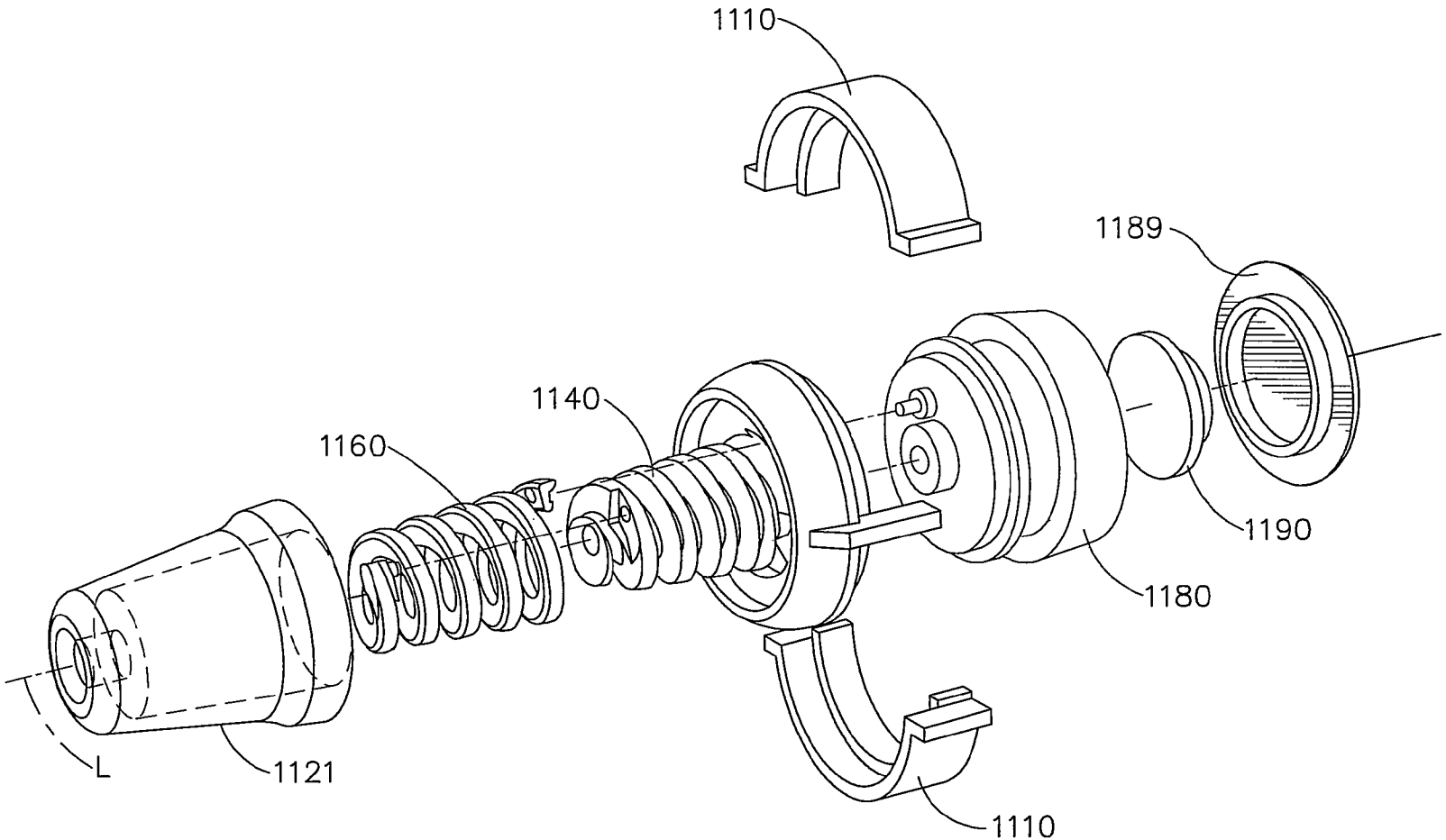
FIG. 15 is an exploded view of the adjustable earphone of FIG. 13.

In various embodiments, referring to FIGS. 13-15, an adjustable earphone 1100 may include another means for adjusting the shape of an ear canal portion 1120 having a first shape 1122 (FIG. 14A) by a user when the ear canal portion 1120 is positioned in the user's ear canal. Means for adjusting the shape of the ear canal portion 1120 may be provided in at least one embodiment by adjustment assembly 1130. Adjustment assembly 1130 may be coupled operably to the housing 1110 and/or to the ear canal portion 1120 such that actuation of the adjustment assembly 1130 causes the ear canal portion 1120 to have a second shape 1123 (FIG. 14A).

As seen at least in FIGS. 13 and/or 15, adjustment assembly 1130 may include fixed element 1140, expansion assembly 1160, and control member 1180. Further, the ear canal portion 1120 may include a cushion 1121. Positioned at least partially within the housing 1110 are a transducer 1190 and a manufacturer logo piece 1189. A cord (not shown) is coupled to the transducer 1190 such that electrical signals can be passed to the transducer 1190 to create audible sound therefrom.

Thus, FIGS. 13-15 depict another earbud 100 according to an aspect of the present disclosure. An adjustment assembly, or actuator assembly 1130, within an eartip 1120 includes an expansion assembly, coiled element 1160, wrapped around an external surface of a fixed element 1140 and attached to the fixed element 1140 at an inner end. A rotating control member 1180 is attached to an outer end of the coiled element 1160. In a compact configuration (see FIG. 14B), the coiled element 1160 lies adjacent to the fixed element 1140 and rotation in a first direction is not possible, because it would cause the coiled element 1160 to wrap more tightly against the fixed element. Rotation in the opposite direction, however, results in an expansion of the diameter of the coiled element 1160, causing the eartip 1120 to expand (see FIG. 14C).

Figure 16:
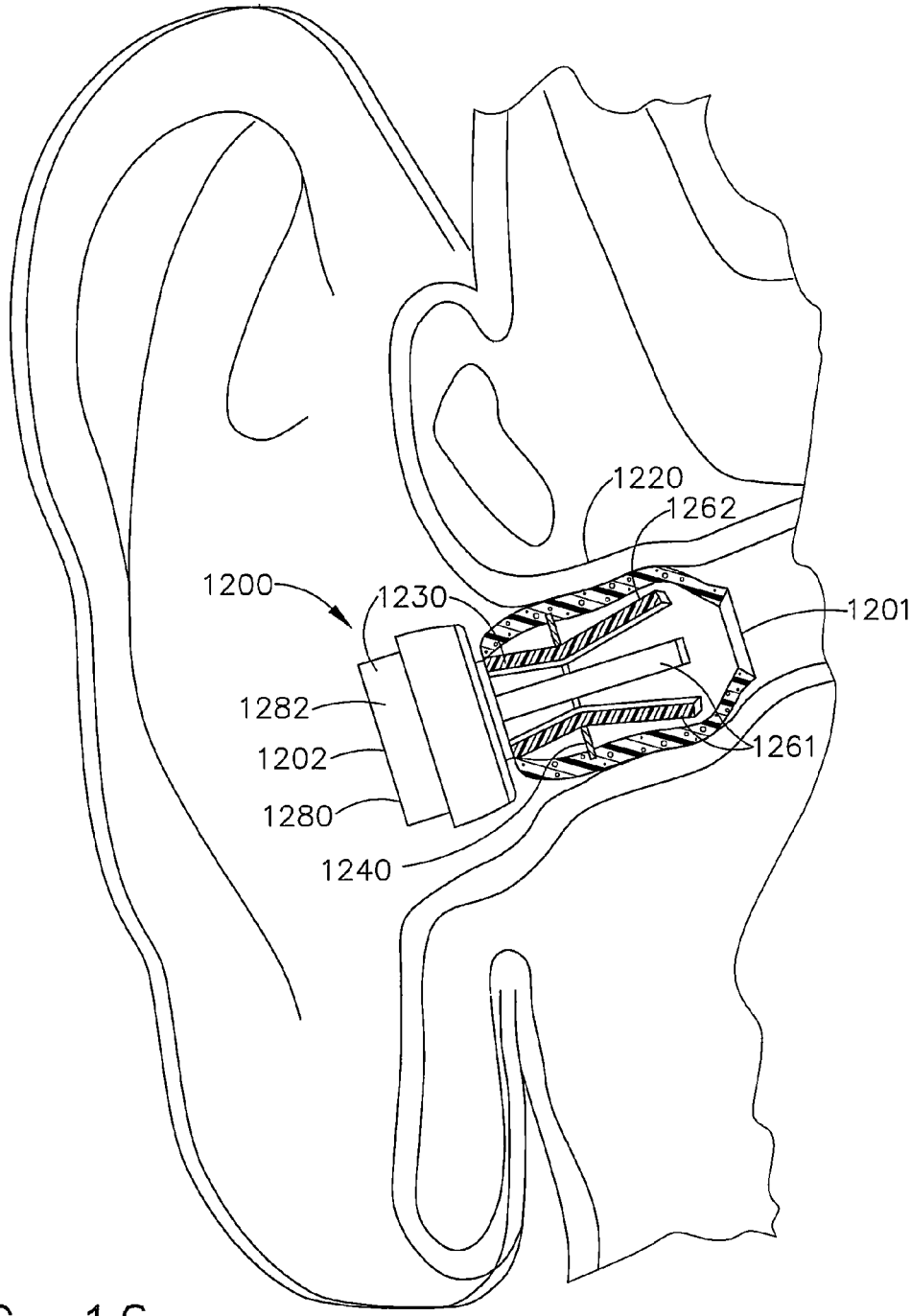
FIG. 16 is a cross-sectional view of one non-limiting embodiment of an adjustable earphone inserted and expanded in a user's ear canal.

FIG. 16 shows an exemplary earbud 1200 according to an aspect of the present disclosure that is adjusted by pressing, rather than rotating, a control 1280. An adjustment, or actuator assembly 1230, has a plurality of stiff fingers 1261 extending from an outer end 1202 to an inner end 1201 within an eartip 1220 and coupled to a button 1282 at an outer end 1202 of the earbud. The fingers 1261 form a profile 1262 with a portion having a narrower radius tapering to a portion having a wider radius. The earbud 1200 also includes a ring 1240 around the fingers 1261, the ring 1240 positioned at a fixed distance inward from the outer end 1202 of the earbud 1200. As the button 1282 is pushed inward or pulled outward, the tapered profile 1262 of the fingers 1261 slides within the ring 1240, the outer end of the fingers 1261 expand or contract radially, and the eartip 1220 expands or contracts.

The earbud 1200 of FIG. 16 and other earbuds or earphones according to aspects of the present disclosure not only cause the outer surface of an eartip to expand, but also cause the inner cavity of the eartip to expand. The expanded cavity provides a larger volume for sound from the earphone to resonate and generates better low frequency response from the earphone.

Figure 17B:
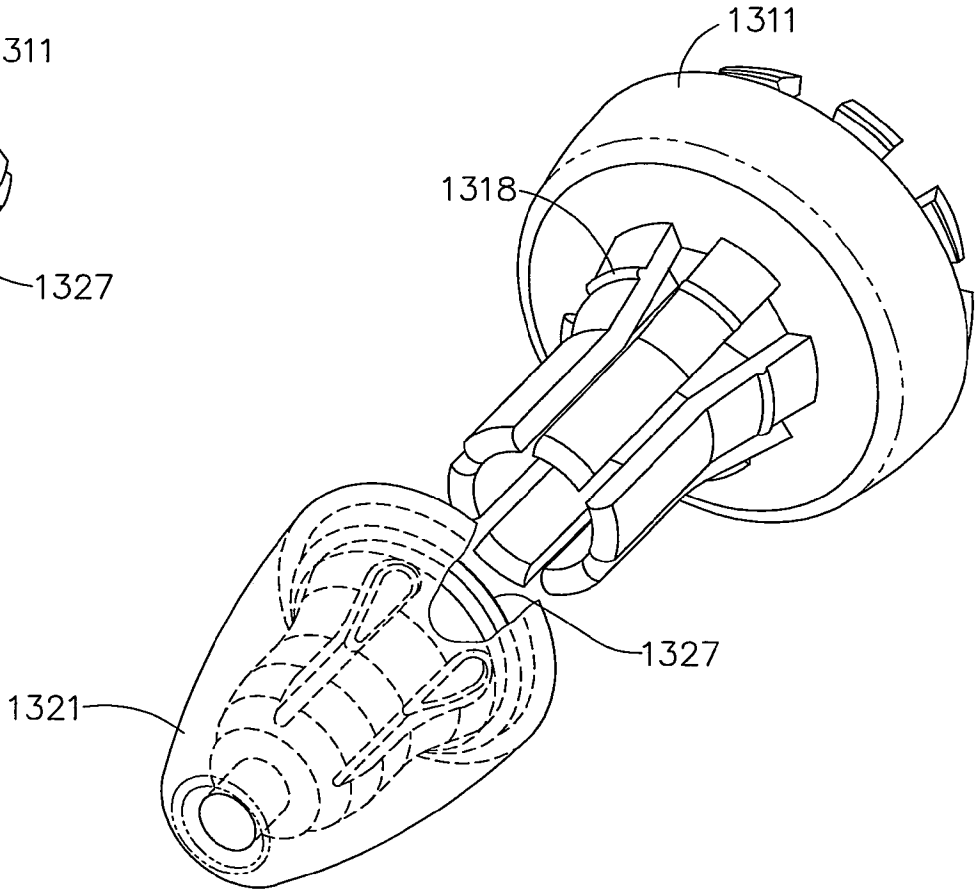
FIGS. 17A-17B are perspective views of a non-limiting embodiment of an eartip cushion and a base housing element of an adjustable earphone.
Figure 17A:
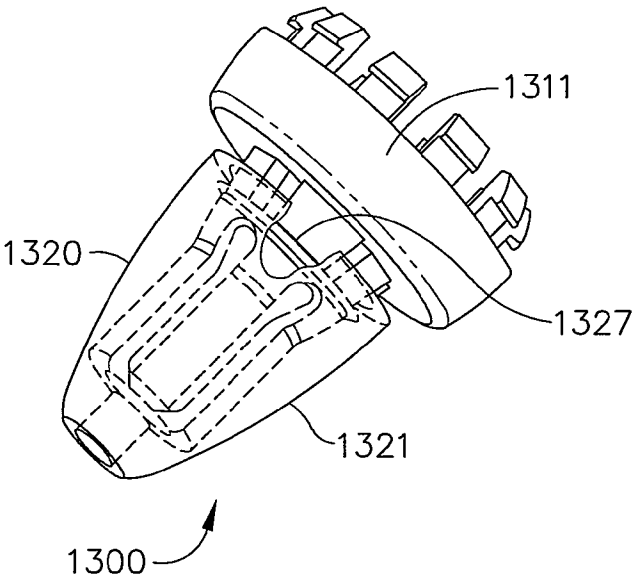

In FIG. 17 a snap ring 1327 is shown that operates to attach an eartip element 1321 to a base element 1311 of an earbud 1300. The snap ring 1327 is located in a first end of the eartip element 1321. The base element 1311 of the earbud 1300 includes a tapering portion with a groove 1318 around the tapering portion that corresponds in size to the snap ring 1327. As the first end of the eartip 1320 is pressed onto the base element, the snap ring 1327 expands elastically around the tapering portion of the base element 1311 until reaching the groove 1318, whereupon it contracts back toward its original diameter. The elastic force of the snap ring 1327 attempting to return to its original diameter holds the snap ring 1327 in the groove 1318 and acts to prevent the eartip 1320 from slipping off the earbud 1300 and sealing the eartip 1320 to the base element 1311. Eartip element 1321 and base element 1311 may form part of a housing of an earphone, such as first side 111 of housing 110 of adjustable earphone 100 described above and seen in FIG. 21A.

FIGS. 18A and 18B also depict a cord 11 according to another aspect of the present disclosure that may be used with earphones, such as the earbuds described above or with other types of earphones. The cord is covered with cloth, foam, or another soft material. The cord has an electrical connector 13 at a first end 11 and one or more earphones 100 at a second end 12. The connector 13 at the first end 11 may be coupled to an audio device 1. When the audio device 1 is not in use, the cord may be wrapped around the audio device 1 and form a cushion (FIG. 18A), protecting the audio device 1 from damage when placed loose in a briefcase, backpack, or other carrier. The earphones 100 at the second end of the cord may be tucked under another section of the cord to prevent the cord from unwrapping from around the audio device 1.

FIGS. 18A, 18B, 19B, and 19C illustrate a cord clip 15 according to another aspect of the present disclosure. An earphone cord 11 may include a first portion 16 adjacent to a first end 11 of the cord 11 where the cord 11 is configured as a single strand. Between the first portion 16 of the cord 11 and a pair of earphones 100 at a second end 12 of the cord, is a second portion 17 of the cord 11, which is configured as two strands that lie along opposite sides of the head when the earphones are inserted into the ears. The two strands of the second portion 17 may pass through two corresponding apertures in a cord clip 15, as shown in FIGS. 18A, 18B, 19B and 19C. When the earphones 100 are in use, the cord clip 15 may be slid toward the first portion 16 of the cord 11, allowing the earphones to be separated and placed in the ears of the user. When the earphones 100 are not in use, the cord clip 15 may be slid toward the second end 12 of the cord 11, to hold the earphones 100 together and make the cord 11 easier to handle than it would be if the earphones 100 were left separated. The cord clip 15 further includes a spring clip 14 that may be used when the cord is wrapped around an audio device 1 to clip the second end 12 of the cord 11 to a portion of the cord closer to the first end 11 of the cord and help to prevent the cord 11 from unwrapping from around the audio device 1.

Although various embodiments have been described herein, many modifications and variations to those embodiments may be implemented. For example, the adjustable earphone may be converted to an adjustable earplug or other adjustable ear insert. Conversion of the above described earphone into an adjustable earplug may be accomplished, for example, by removing the electrical components and removing the passageways for sound to travel, thereby providing an earplug with an adjustable shape when placed in an ear canal of a user. Further, while the general components of the adjustable earphone described above may be made of plastic (except at least parts of the cord, the eartip cushion, and the transducer), metal or other materials may be used where desirable. The foregoing description and following claims are intended to convey and cover all such modification and variations.

Any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

What is claimed is:

1. An adjustable earphone, comprising:

a housing having a first side and a second side;

a resilient cushion attached to the first side of the housing, the resilient cushion having a compact shape and an opening;

at least one cantilever arm protruding from the first side of the housing, wherein at least part of the cantilever arm is located within the opening of the resilient cushion;

a dial rotatably mounted in the housing, wherein at least part of the dial extends from the second side of the housing, wherein the dial includes threads; and an actuator comprising a first portion and a second portion, the second portion having threads, wherein the actuator is slidably mounted in the housing, wherein the actuator threads operably engage the dial threads such that rotation of the dial in a first direction translates the first portion of the rigid actuator into contact with the cantilever arm;

wherein the first portion of the actuator is configured to bend the cantilever arm into the resilient cushion as the actuator contacts the arm, wherein the cantilever arm is configured to force the resilient cushion to have an expanded shape as the cantilever arm bends into the cushion.

2. The adjustable earphone of claim 1, further comprising a cord having a first end, a second end, and an electrical connector located at the first end, wherein the housing is located at the second end of the cord, wherein the cord is at least partially covered with a soft material.

3. The adjustable earphone of claim 2, wherein the soft material comprises a cloth.

4. The adjustable earphone of claim 2, further comprising a cord clip, wherein the cord further comprises a first portion adjacent to the first end of the cord and a second portion adjacent to the second end of the cord, wherein the first portion comprises a single strand and the second portion comprises two strands, wherein the cord clip is slidably coupled to the two strands of the second portion.

5. The adjustable earphone of claim 4, wherein the cord clip further comprises two apertures, wherein each aperture is configured to insertably receive one of the two strands of the second portion of the cord.

6. The adjustable earphone of claim 4, wherein the cord clip further comprises a spring clip that is configured to clip to the cord.

7. An adjustable earphone, comprising:

a housing having a first side and a second side, wherein the first side of the housing is configured to attach to a cushion;

at least one cantilever arm protruding from the first side of the housing, wherein at least part of the cantilever arm is configured to be located within an opening of the cushion when the cushion is attached to the housing;

a dial rotatably mounted in the housing, wherein at least part of the dial extends from the second side of the housing, wherein the dial includes threads; and an actuator comprising a first portion and a second portion, the second portion having threads, wherein the actuator is slidably mounted in the housing, wherein the actuator threads operably engage the dial threads such that rotation of the dial in a first direction translates the first portion of the rigid actuator into contact with the cantilever arm;

wherein the first portion of the actuator is configured to bend the cantilever arm as the actuator contacts the arm.

8. The adjustable earphone of claim 7, further comprising a cord having a first end, a second end, and an electrical connector located at the first end, wherein the housing is located at the second end of the cord, wherein the cord is at least partially covered with a soft material.

9. The adjustable earphone of claim 8, wherein the soft material comprises a cloth.

10. The adjustable earphone of claim 8, further comprising a cord clip, wherein the cord further comprises a first portion adjacent to the first end of the cord and a second portion adjacent to the second end of the cord, wherein the first portion comprises a single strand and the second portion comprises two strands, wherein the cord clip is slidably coupled to the two strands of the second portion.

11. The adjustable earphone of claim 10, wherein the cord clip further comprises two apertures, wherein each aperture is configured to insertably receive one of the two strands of the second portion of the cord.

12. The adjustable earphone of claim 10, wherein the cord clip further comprises a spring clip that is configured to clip to the cord.

13. An adjustable earphone, comprising:

a housing;

an ear canal portion adjacent to the housing, the ear canal portion having a first shape; and an adjustment assembly operably coupled to the housing such that actuation of the adjustment assembly causes the ear canal portion to have at least a second shape without external force being applied to or removed from the ear canal portion, wherein at least part of the adjustment assembly is accessible to and operable by a user when the ear canal portion is inserted in the user's ear canal;

wherein the adjustment assembly comprises a control member accessible to a user and an expansion assembly operably coupled to the control member, wherein the control member is configured to actuate the expansion assembly such that the ear canal portion has at least a second shape when the expansion assembly is actuated; and wherein the expansion assembly comprises a rotatable actuator having lobes.

14. The adjustable earphone of claim 13, further comprising a cord having a first end, a second end, and an electrical connector located at the first end, wherein the housing is located at the second end of the cord, wherein the cord is at least partially covered with a soft material.

15. The adjustable earphone of claim 14, wherein the soft material comprises a cloth.

16. The adjustable earphone of claim 14, further comprising a cord clip, wherein the cord further comprises a first portion adjacent to the first end of the cord and a second portion adjacent to the second end of the cord, wherein the first portion comprises a single strand and the second portion comprises two strands, wherein the cord clip is slidably coupled to the two strands of the second portion.

17. The adjustable earphone of claim 16, wherein the cord clip further comprises two apertures, wherein each aperture is configured to insertably receive one of the two strands of the second portion of the cord.

18. The adjustable earphone of claim 16, wherein the cord clip further comprises a spring clip that is configured to clip to the cord.

* * * * *